US008487520B2

(12) United States Patent
Sakayanagi et al.

(10) Patent No.: US 8,487,520 B2
(45) Date of Patent: Jul. 16, 2013

(54) SPARK PLUG AND METHOD OF MANUFACTURING THE SAME

(75) Inventors: Nobuaki Sakayanagi, Toyohashi (JP); Katsutoshi Nakayama, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 140 days.

(21) Appl. No.: 12/960,105

(22) Filed: Dec. 3, 2010

(65) Prior Publication Data

US 2011/0133625 A1 Jun. 9, 2011

(30) Foreign Application Priority Data

Dec. 4, 2009 (JP) ..... 2009-276230

(51) Int. Cl.
*H01T 13/20* (2006.01)

(52) U.S. Cl.
USPC ..... 313/142; 313/118; 313/141; 313/144

(58) Field of Classification Search
USPC ..... 313/141, 142, 118, 144
See application file for complete search history.

(56) References Cited

U.S. PATENT DOCUMENTS

| | | | | |
|---|---|---|---|---|
| 5,488,262 | A * | 1/1996 | Takamura | 313/141 |
| 5,527,198 | A * | 6/1996 | Chiu et al. | 445/7 |
| 6,337,533 | B1 | 1/2002 | Hanashi et al. | |
| 6,642,638 | B2 * | 11/2003 | Ishiguro | 313/141 |
| 6,853,116 | B2 * | 2/2005 | Hori et al. | 313/141 |
| 6,923,699 | B2 * | 8/2005 | Matsubara et al. | 445/7 |
| 7,045,939 | B2 * | 5/2006 | Teramura et al. | 313/141 |
| 7,192,324 | B2 | 3/2007 | Juestel et al. | |
| 7,306,502 | B2 * | 12/2007 | Hori | 445/7 |
| 8,044,562 | B2 | 10/2011 | Musasa et al. | |
| 2002/0003389 | A1 * | 1/2002 | Ishiguro | 313/141 |
| 2002/0105254 | A1 | 8/2002 | Hori et al. | |
| 2002/0121849 | A1 * | 9/2002 | Kanao et al. | 313/141 |
| 2002/0130603 | A1 * | 9/2002 | Teramura et al. | 313/141 |
| 2003/0181121 | A1 * | 9/2003 | Matsubara et al. | 445/7 |
| 2004/0061421 | A1 * | 4/2004 | Morita et al. | 313/142 |
| 2005/0176332 | A1 | 8/2005 | Jeustel et al. | |
| 2006/0276097 | A1 | 12/2006 | Suzuki et al. | |
| 2007/0103046 | A1 * | 5/2007 | Tinwell | 313/143 |
| 2010/0264796 | A1 | 10/2010 | Musasa et al. | |

FOREIGN PATENT DOCUMENTS

| | | | |
|---|---|---|---|
| EP | 2221931 | A1 | 8/2010 |
| JP | 11354251 | A | 12/1999 |
| JP | 2004-517459 | A | 6/2004 |
| JP | 2005-158323 | A | 6/2005 |
| JP | 3820756 | B2 | 9/2006 |

(Continued)

*Primary Examiner* — Nimeshkumar Patel
*Assistant Examiner* — Thomas A Hollweg
(74) *Attorney, Agent, or Firm* — Sughrue Mion, PLLC

(57) ABSTRACT

A spark plug (1) including a noble metal tip joined to a ground electrode and forming a spark discharge gap in cooperation with a center electrode. A surface of the noble metal tip which forms the gap has an area of 0.9 $mm^2$ or greater. The noble metal tip (32) is joined to the ground electrode (27) via a fusion zone (35) formed by irradiating at least one surface among a distal end surface and side surfaces of the ground electrode with a laser beam or an electron beam. Further, as viewed on a projection plane orthogonal to a center axis of the noble metal tip and on which the noble metal tip and the fusion zone are projected along the center axis, an overlapping region between the noble metal tip (32) and the fusion zone accounts for 70% or more of a projected region of the noble metal tip.

12 Claims, 18 Drawing Sheets

FOREIGN PATENT DOCUMENTS

| | | | |
|---|---|---|---|
| JP | 2007087969 | A | 4/2007 |
| JP | 4075137 | B2 | 4/2008 |
| JP | 4092889 | B2 | 5/2008 |
| WO | 2009063914 | A1 | 5/2009 |

* cited by examiner

SPARK PLUG AND METHOD OF MANUFACTURING THE SAME

BACKGROUND OF THE INVENTION

1. Field of the Invention

The present invention relates to a spark plug for use in an internal combustion engine or the like, and to a method of manufacturing the same.

2. Description of the Related Art

A spark plug for use in a combustion apparatus, such as an internal combustion engine, includes, for example, a center electrode extending in an axial direction; an insulator surrounding the center electrode; a cylindrical metallic shell externally assembled to the insulator; and a ground electrode whose proximal end portion is joined to a front end portion of the metallic shell. The ground electrode is bent at its substantially intermediate portion so that a distal end portion of the ground electrode faces a front end portion of the center electrode, thereby forming a spark discharge gap between the front end portion of the center electrode and the distal end portion of the ground electrode.

In recent years, a technique has been known for improving erosion resistance by means of joining a noble metal tip to a distal end portion of the ground electrode in a region adapted to form the spark discharge gap. According to a generally employed method for joining the noble metal tip to the ground electrode, the periphery of a contact surface between the ground electrode and the noble metal tip is irradiated with a laser beam. A fusion zone is thereby formed where metal materials of the ground electrode and the noble metal tip are fused and joined together (refer to, for example, Patent Document 1).

Meanwhile, from the viewpoint of further improving erosion resistance, increasing the diameter of the noble metal tip has been considered for increasing the area of a surface (discharge surface) adapted to form the spark discharge gap of the noble metal tip.

[Patent Document 1] Japanese Patent Application Laid-Open (kokai) No. 2005-158323

3. Problems to be Solved by the Invention

However, thermal stress difference becomes relatively large between the ground electrode and the noble metal tip having an increased diameter. Also, since the noble metal tip has an increased diameter, when the noble metal tip is joined to the ground electrode, the penetration depth of the fusion zone may become excessively small as compared with the size of the noble metal tip. That is, in the case of using a noble metal tip having an increased diameter, the thermal stress difference between the ground electrode and the noble metal tip increases. As a result, it becomes difficult to form the fusion zone to a sufficient depth, the fusion zone having the role of absorbing the thermal stress difference. Therefore, there is deep concern about the progress of oxide scale in a joined portion between the ground electrode and the noble metal tip and associated separation of the noble metal tip from the ground electrode.

In this connection, increasing the irradiation energy of a laser beam may be contemplated for increasing the penetration depth of the fusion zone. However, a mere increase in irradiation energy may cause the fusion zone to reach or come close to the discharge surface, potentially resulting in a failure to sufficiently exhibit the effect of improving erosion resistance by providing the noble metal tip.

Another means for preventing the fusion zone from reaching or coming close to the discharge surface by increasing the thickness of the noble metal tip might also be contemplated.

However, since a noble metal alloy used to form the noble metal tip is expensive, if the noble metal tip that is increased in diameter is further increased in thickness, the cost may increase considerably. In actuality, reducing the thickness of the noble metal tip is rather desired for restraining, to the greatest possible extent, an increase in cost associated with an increase in diameter.

SUMMARY OF THE INVENTION

The present invention has been made in view of the above circumstances, and an object thereof is to provide a spark plug in which a noble metal tip having a relatively large diameter is joined to a ground electrode, and which can restrain an increase in cost while sufficiently ensuring separation resistance of the noble metal tip, as well as a method of manufacturing the same.

Configurations suitable for solving the above problems will next be described in itemized form. Actions and effects associated with the various configurations will also be described.

The above objects have been achieved by providing a spark plug and method configured as follows.

Configuration 1. A spark plug comprising a tubular insulator having an axial hole extending therethrough in an axial direction of the spark plug; a center electrode inserted into a front end portion of the axial hole; a tubular metallic shell surrounding the insulator; a ground electrode disposed at a front end portion of the metallic shell; and a noble metal tip joined to a distal end portion of the ground electrode and forming a gap in cooperation with a front end portion of the center electrode. A surface of the noble metal tip which forms the gap has an area of 0.9 $mm^2$ or greater. The noble metal tip is joined to the ground electrode via a fusion zone formed through fusion of a portion of the ground electrode and a portion of the noble metal tip by irradiating at least one surface among a distal end surface and side surfaces of the ground electrode with a laser beam or an electron beam. Further, as viewed on a projection plane orthogonal to a center axis of the noble metal tip and on which the noble metal tip and the fusion zone are projected along the center axis, an overlapping region between the noble metal tip and the fusion zone accounts for 70% or more of a projected region of the noble metal tip.

Notably, "side surfaces of the ground electrode" refers to surfaces of the ground electrode (excluding the distal end surface of the ground electrode) which are adjacent to the surface that faces the center electrode.

According to configuration 1, the noble metal tip has a relatively large diameter such that the surface (discharge surface) which forms the gap has an area of 0.9 $mm^2$ or greater. Thus, improvement in erosion resistance is expected from the noble metal tip, whereas, as mentioned previously, there is deep concern about separation of the noble metal tip from the ground electrode.

According to configuration 1, as viewed on a projection plane which is orthogonal to the center axis of the noble metal tip and on which the noble metal tip and the fusion zone are projected along the center axis, an overlapping region between the noble metal tip and the fusion zone accounts for 70% or more of a projected region of the noble metal tip. That is, the noble metal tip is joined to the ground electrode via a sufficiently wide fusion zone. Therefore, even though a relatively large thermal stress difference arises between the noble metal tip having a large diameter and the ground electrode, the fusion zone can sufficiently absorb the difference, whereby the progress of oxide scale in a joined portion between the ground electrode and the noble metal tip can be reliably prevented. As a result, separation resistance of the noble metal tip can be more reliably improved.

Also, the fusion zone is formed by irradiating at least one surface among the distal end surface and side surfaces of the ground electrode with a laser beam or an electron beam, rather than the periphery of a contact surface between the ground electrode and the noble metal tip. Therefore, even though a sufficiently wide fusion zone is formed as mentioned above, the fusion zone is unlikely to reach or come close to the discharge surface, and the effect of improving erosion resistance can be sufficiently realized by providing the noble metal tip. As a result, coupled with the effect yielded by the discharge surface of the noble metal tip having an area of 0.9 $mm^2$ or greater, erosion resistance can be remarkably improved.

Further, since the fusion zone can be restrained from reaching or coming close to the discharge surface, a noble metal tip having a relatively small thickness (e.g., 0.5 mm or less) can be used. Thus, an increase in manufacturing cost associated with use of a noble metal tip having an increased diameter can be effectively restrained.

Configuration 2. The spark plug according to configuration 1, wherein the fusion zone is formed along an entire boundary between the ground electrode and a peripheral portion of a proximal end portion of the noble metal tip.

According to configuration 2, the fusion zone is formed so as to cover a boundary portion between the noble metal tip and the ground electrode. Therefore, the presence of the fusion zone can effectively prevent entry of corrosive gas into the boundary portion and can more reliably prevent the progress of oxide scale in a joined portion between the noble metal tip and the ground electrode. As a result, separation resistance of the noble metal tip can be further improved.

Configuration 3. The spark plug according to configuration 1 or 2, wherein the fusion zone is formed by irradiating at least a first surface and a second surface different from the first surface among the distal end surface and the side surfaces of the ground electrode with the laser beam or the electron beam, and wherein a first fusion region formed by irradiating the first surface and a second fusion region formed by irradiating the second surface overlap each other, thereby forming an overlap fusion region.

According to configuration 3, the fusion zone has an overlap fusion region formed by an overlap of the first fusion region and the second fusion region. That is, the fusion zone is formed so as to extend between the distal end surface of the ground electrode and at least one of the two side surfaces of the ground electrode, or so as to extend between the side surfaces of the ground electrode, or in such a manner as to extend between the distal end surface and the two side surfaces of the ground electrode. Therefore, the joining strength of the noble metal tip to the ground electrode can be enhanced, whereby separation resistance of the noble metal tip can be further improved.

Configuration 4. The spark plug according to configuration 3, wherein when the noble metal tip, the fusion zone, and a straight line intersecting the center axis of the noble metal tip and extending along the longitudinal direction of the ground electrode are projected on a projection plane along the center axis of the noble metal tip, the overlap fusion region overlaps the straight line in the projected region of the noble metal tip.

According to configuration 4, the fusion zone can reliably absorb the thermal stress difference which arises between the ground electrode and the noble metal tip. Thus, the progress of oxide scale in a joined portion between the ground electrode and the noble metal tip can be quite effectively prevented, whereby separation resistance of the noble metal tip can be further improved.

Configuration 5. The spark plug according to configuration 3, wherein when the center axis of the noble metal tip and the fusion zone are projected on a projection plane along the center axis of the noble metal tip, the overlap fusion region overlaps the center axis of the noble metal tip.

According to configuration 5, the fusion zone can further reliably absorb the thermal stress difference which arises between the ground electrode and the noble metal tip, whereby separation resistance of the noble metal tip can be remarkably improved.

Configuration 6. The spark plug according to any one of configurations 1 to 5, wherein the fusion zone is not exposed from the surface of the noble metal tip forming the gap.

According to configuration 6, since the fusion zone, which is inferior to the noble metal tip in erosion resistance, is not exposed from the discharge surface, the effect of improving erosion resistance can further be exhibited by providing the noble metal tip.

Configuration 7. The spark plug according to any one of configurations 1 to 6, wherein the noble metal tip contains at least one selected from the group consisting of iridium (Ir), platinum (Pt), rhodium (Rh), ruthenium (Ru), palladium (Pd) and rhenium (Re).

According to configuration 7, the metal material of the noble metal tip contains Pt, Ir, etc., whereby erosion resistance can be further improved.

Configuration 8. A method of manufacturing a spark plug according to any one of configurations 1 to 7. The method comprises placing the noble metal tip on the ground electrode and irradiating a laser beam or an electron beam along a direction which is inclined relative to a contact surface between the noble metal tip and the ground electrode from a side of the contact surface opposite the surface of the noble metal tip which forms the gap, to thereby join the noble metal tip to the ground electrode.

According to configuration 8, in joining the noble metal tip to the ground electrode, the laser beam or the electron beam is irradiated along a direction which is inclined from a direction parallel to the surface (discharge surface) of the noble metal tip adapted to form the gap toward the back surface of the ground electrode. Therefore, a portion of the noble metal tip which is melted in joining can be reduced, so that the noble metal tip has a sufficient thickness after joining. As a result, erosion resistance can be further improved.

The fusion zone formed by action of the laser beam or the electron beam could have fine irregularities on its surface. Thus, at the time of discharge, a discharge may be generated between the center electrode and the irregular surface, which is relatively high in electric field strength, potentially resulting in a deterioration in durability. However, according to configuration 8, the fusion zone can be readily formed so as not to be exposed on a side toward the gap (spark discharge gap). Therefore, by employing configuration 8 to thereby prevent exposure of the fusion zone toward the gap, a discharge between the fusion zone and the center electrode can be effectively restrained, whereby durability can be improved.

Configuration 9. The method of manufacturing a spark plug according to configuration 8, which comprises joining the noble metal tip to the ground electrode using a fiber laser or the electron beam.

According to configuration 9, while the fusion zone is held relatively thin, the fusion zone can be extended deep into the ground electrode. Thus, even though the fusion zone is formed over a relatively large region as described above, the fusion zone can have a relatively small volume. Therefore, a portion of the noble metal tip which is melted in joining can be further reduced, so that the noble metal tip has a sufficient thickness (volume) after joining. As a result, erosion resistance can be further improved.

DESCRIPTION OF REFERENCE NUMERALS

Figure 1:
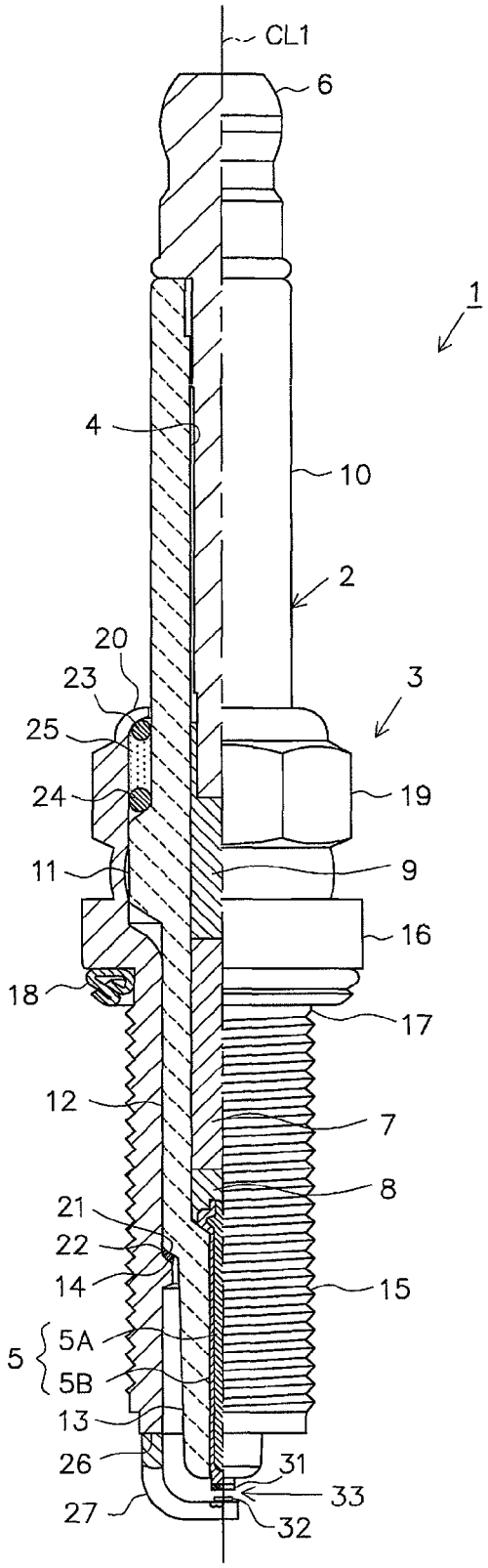
FIG. 1 is a partially cutaway front view showing the configuration of a spark plug.

Reference numerals used to identify various structural features shown in the drawings include the following.

1: spark plug
2: insulator
3: metallic shell
4: axial hole
5: center electrode
27: ground electrode
27F: distal end surface (of ground electrode)
27S1, 27S2: side surface (of ground electrode)
32: noble metal tip
33: spark discharge gap
35: fusion zone
35*a*, 35*b*, 35*c*, 35*d*, 35*e*: fusion region
37*a*, 37*b*, 37*c*, 37*d*, 37*e*: overlap fusion region
CL1: axis
CL2: center axis (of noble metal tip)

DETAILED DESCRIPTION OF THE PREFERRED EMBODIMENTS

The present invention will now be described in detail with reference to the drawings. However, the present invention should not be construed as being limited thereto.

First Embodiment

FIG. 1 is a partially cutaway front view showing a spark plug 1. In FIG. 1, the direction of an axis CL1 of the spark plug 1 is referred to as the vertical direction. In the following description, the lower side of the spark plug 1 in FIG. 1 is referred to as the front side of the spark plug 1, and the upper side as the rear side.

The spark plug 1 includes a tubular insulator 2 and a tubular metallic shell 3, which holds the insulator 2 therein.

The insulator 2 is formed from alumina or the like by firing, as well known in the art. The insulator 2, as viewed externally, includes a rear trunk portion 10 formed on the rear side; a large-diameter portion 11, which is located frontward of the rear trunk portion 10 and projects radially outward; an intermediate trunk portion 12, which is located frontward of the large-diameter portion 11 and is smaller in diameter than the large-diameter portion 11; and a leg portion 13, which is located frontward of the intermediate trunk portion 12 and is smaller in diameter than the intermediate trunk portion 12. Of the insulator 2, the large-diameter portion 11, the intermediate trunk portion 12, and most of the leg portion 13 are accommodated in the metallic shell 3. A tapered, stepped portion 14 is formed at a connection portion between the leg portion 13 and the intermediate trunk portion 12. The insulator 2 is seated on the metallic shell 3 at the stepped portion 14.

The insulator 2 has an axial hole 4 extending therethrough along the axis CL1. A center electrode 5 is fixedly inserted into a front end portion of the axial hole 4. The center electrode 5 includes an inner layer 5A made of copper or a copper alloy, which has excellent thermal conductivity, and an outer layer 5B made of an Ni alloy which contains nickel (Ni) as a main component. Further, the center electrode 5 assumes a rodlike (circular columnar) shape as a whole; has a flat front end surface; and projects from the front end of the insulator 2. A noble metal member 31 made of a predetermined noble metal alloy (e.g., a platinum alloy or an iridium alloy) is provided at a front end portion of the center electrode 5.

A terminal electrode 6 is fixedly inserted into a rear end portion of the axial hole 4 and projects from the rear end of the insulator 2.

Further, a circular columnar resistor 7 is disposed within the axial hole 4 between the center electrode 5 and the terminal electrode 6. Opposite end portions of the resistor 7 are electrically connected to the center electrode 5 and the terminal electrode 6 via conductive glass seal layers 8 and 9, respectively.

Additionally, the metallic shell 3 is formed into a tubular shape from a low-carbon steel or a like metal. The metallic shell 3 has a threaded portion (externally threaded portion) 15 on its outer circumferential surface. The threaded portion 15 is adapted to mount the spark plug 1 into a mounting hole formed in a combustion apparatus (e.g., an internal combustion engine and a fuel cell reformer). The metallic shell 3 has a seat portion 16 formed on its outer circumferential surface and located rearward of the threaded portion 15. A ring-like gasket 18 is fitted to a screw neck 17 located at the rear end of the threaded portion 15. Also, the metallic shell 3 has a tool engagement portion 19 provided near its rear end. The tool engagement portion 19 has a hexagonal cross section and allows a tool such as a wrench to engage therewith when the metallic shell 3 is to be attached to the combustion apparatus. Further, the metallic shell 3 has a crimp portion 20 provided at its rear end portion and adapted to hold the insulator 2.

Also, the metallic shell 3 has a tapered, stepped portion 21 provided on its inner circumferential surface and adapted to allow the insulator 2 to be seated thereon. The insulator 2 is inserted frontward into the metallic shell 3 from the rear end of the metallic shell 3. In a state in which the stepped portion 14 of the insulator 2 abuts the stepped portion 21 of the metallic shell 3, a rear-end opening portion of the metallic shell 3 is crimped radially inward; i.e., the crimp portion 20 is formed, whereby the insulator 2 is fixed in place. An annular sheet packing 22 intervenes between the stepped portions 14 and 21 of the insulator 2 and the metallic shell 3, respectively. This retains gastightness of a combustion chamber and prevents leakage of fuel gas to the exterior of the spark plug 1 through a clearance between the inner circumferential surface of the metallic shell 3 and the leg portion 13 of the insulator 2, which leg portion 13 is exposed to the combustion chamber.

Further, in order to ensure gastightness which is established by crimping, annular ring members 23 and 24 intervene between the metallic shell 3 and the insulator 2 in a region near the rear end of the metallic shell 3, and a space between the ring members 23 and 24 is filled with a talc powder 25. That is, the metallic shell 3 holds the insulator 2 via the sheet packing 22, the ring members 23 and 24, and the talc 25.

A ground electrode 27 is joined to a front end portion 26 of the metallic shell 3. A substantially intermediate portion of the ground electrode 27 is bent such that a side surface of a distal end portion of the ground electrode 27 faces a front end portion (noble metal member 31) of the center electrode 5. The ground electrode 27 is formed of an Ni alloy and has a circular columnar noble metal tip 32 joined to a region of the ground electrode 27 which faces the noble metal member 31. The noble metal tip 32 is formed of a noble metal alloy which contains at least one of iridium, platinum, rhodium, ruthenium, palladium and rhenium. A spark discharge gap 33 is formed between the noble metal member 31 and the distal end surface (discharge surface) of the noble metal tip 32. Spark discharges are generated across the spark discharge gap 33 along the axis CL1.

Additionally, in order to improve erosion resistance, the noble metal tip 32 has a relatively large diameter. Specifically, in the present embodiment, a surface (discharge surface) of the noble metal tip 32 adapted to form the spark discharge gap 33 has an area of 0.9 $mm^2$ or greater. However, in order to restrain an increase in cost associated with an increase in diameter, the noble metal tip 32 is rendered relatively thin (e.g., a thickness of 0.5 mm or less).

Figure 2A:
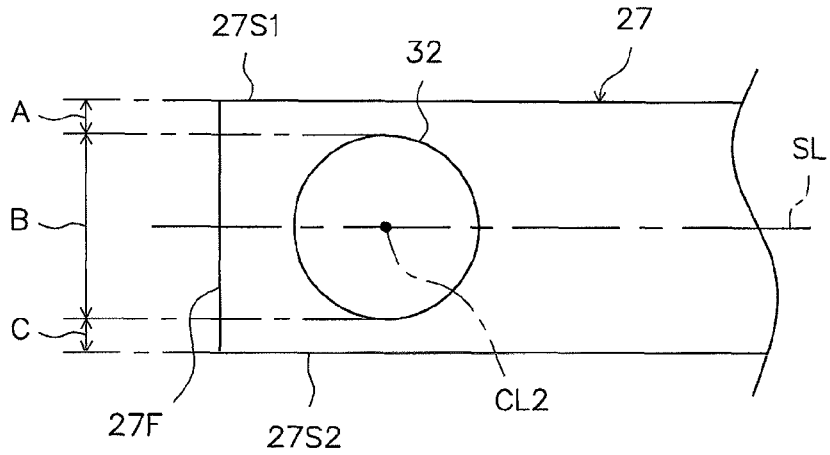
FIG. 2 includes a pair of views showing a front end portion of the spark plug, wherein FIG. 2(*a*) is an enlarged partial view showing the joining position of a noble metal tip to a ground electrode, and FIG. 2(*b*) is an enlarged partially cutaway front view showing the configuration of the front end portion of the spark plug.
Figure 2B:
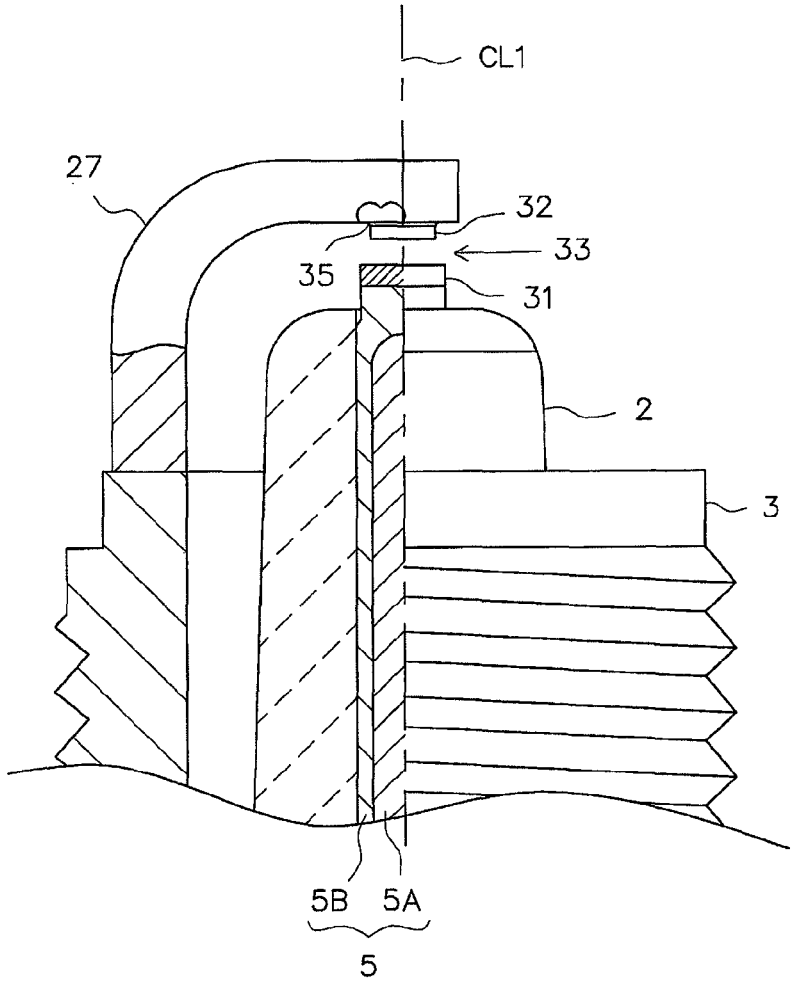

Further, in order to improve ignition performance, the ground electrode 27 is formed relatively slender. However, in view of attainment of a sufficient joining area between the ground electrode 27 and the noble metal tip 32, as shown in FIG. 2(*a*), the width of the ground electrode 27 is rendered greater than the outside diameter of the noble metal tip 32. Further, the noble metal tip 32 is joined to the ground electrode 27 such that a center axis CL2 of the noble metal tip 32 is positioned at the center of the width of the ground electrode 27. Thus, when A (mm) represents the distance from a side surface 27S1 of the ground electrode 27 to the noble metal tip 32 as measured along a direction orthogonal to the center axis CL2 of the noble metal tip 32 and to a straight line SL extending along the longitudinal direction of the ground electrode 27, B (mm) represents the width of the noble metal tip 32, and C (mm) represents the distance from the noble metal tip 32 to a side surface 27S2 of the ground electrode 27, the relationship $A+B+C \leqq 3.0$ is satisfied.

Additionally, as shown in FIG. 2(*b*), etc., the noble metal tip 32 is joined to the ground electrode 27 via a fusion zone 35 formed through fusion of a metal material of the ground electrode 27 and a metal material of the noble metal tip 32 (in FIG. 2(*a*), the fusion zone 35 is not shown). In the present embodiment, the fusion zone 35 is formed along the entire boundary between the ground electrode 27 and a peripheral portion of a proximal end portion of the noble metal tip 32.

Figure 3A:
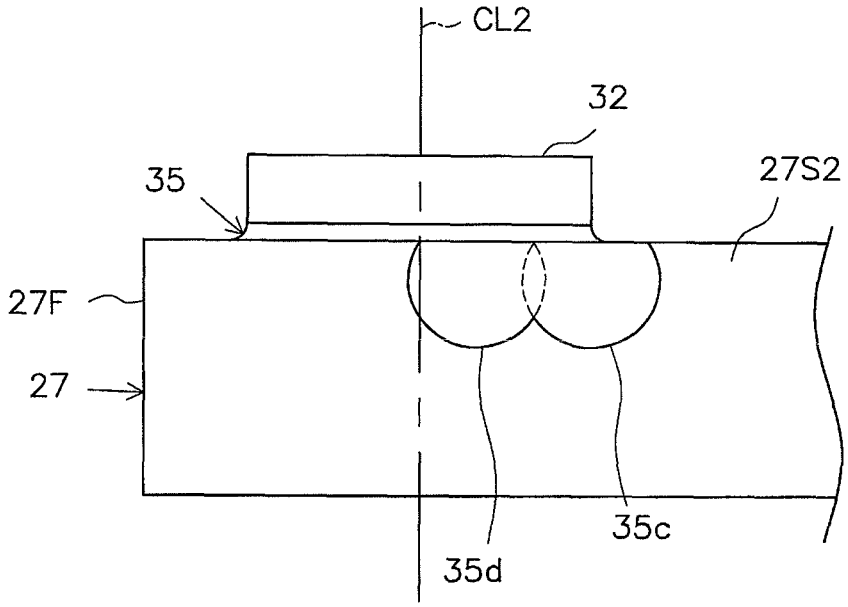
FIG. 3 includes a pair of views illustrating the configuration of a fusion zone in a first embodiment of the present invention, wherein FIG. 3(*a*) is an enlarged partial side view showing a distal end portion of the ground electrode, and FIG. 3(*b*) is a projection view showing a plane of projection on which the noble metal tip, the fusion zone, etc., are projected.
Figure 3B:
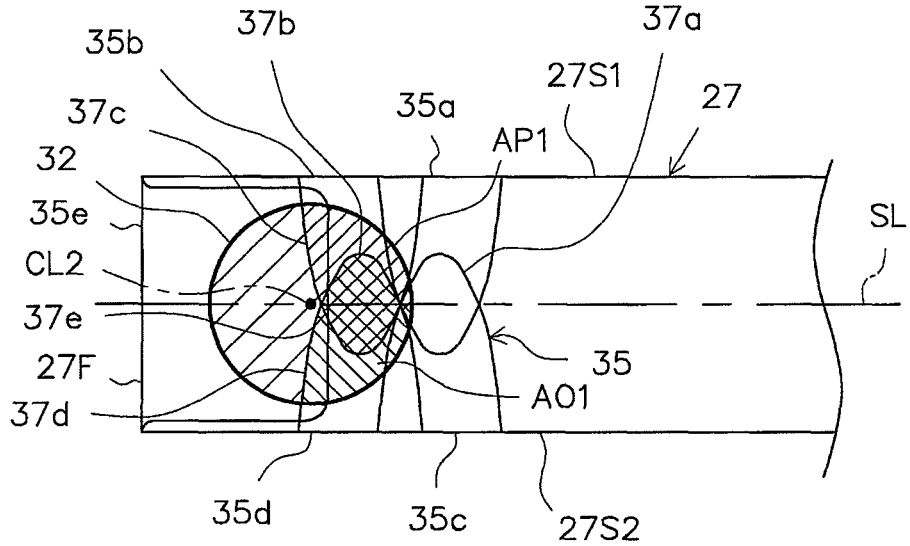
Figure 4:
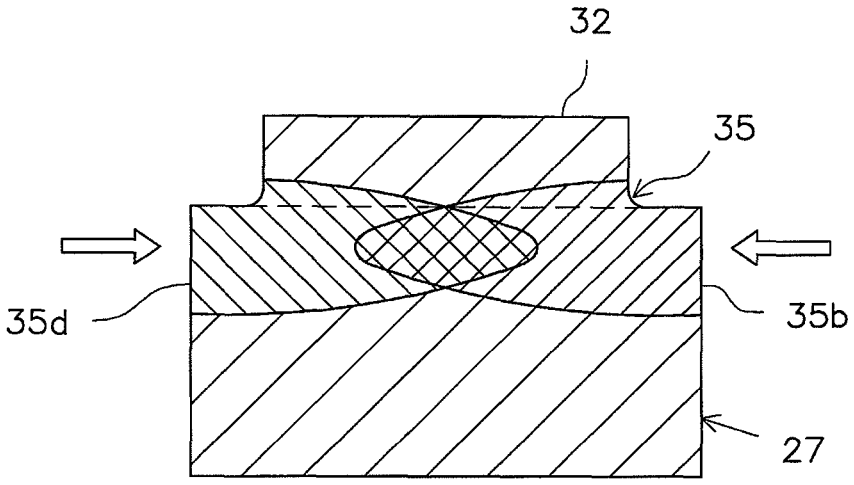
FIG. 4 is an enlarged partial, sectional view showing the fusion zone, etc.
Figure 5A:
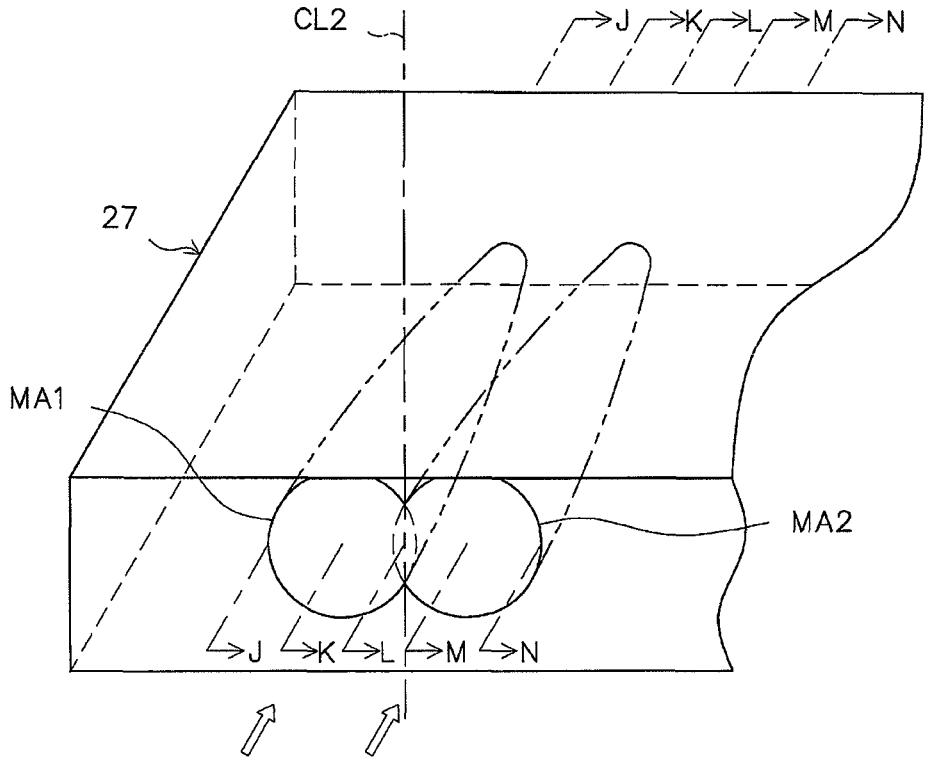
FIG. 5 includes a set of views illustrating a method of obtaining the shape and position of an overlap fusion region, wherein FIG. 5(*a*) is a schematic perspective view showing the ground electrode, etc., FIG. 5(*b*) is a sectional view taken along line J-J of FIG. 5(*a*), FIG. 5(*c*) is a sectional view taken along line K-K of FIG. 5(*a*), FIG. 5(*d*) is a sectional view taken along line L-L of FIG. 5(*a*), FIG. 5(*e*) is a sectional view taken along line M-M of FIG. 5(*a*), and FIG. 5(*f*) is a sectional view taken along line N-N of FIG. 5(*a*).
Figure 5B:
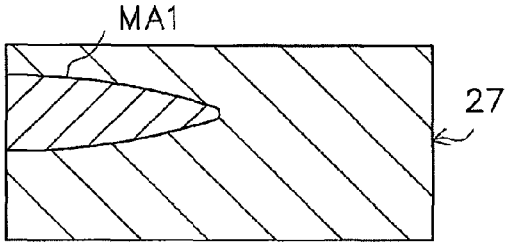
Figure 5C:
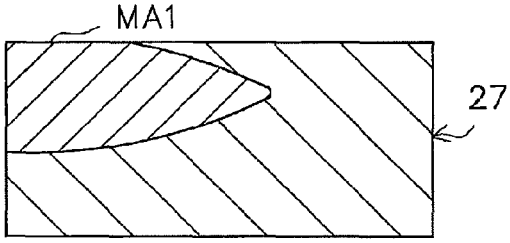
Figure 5D:
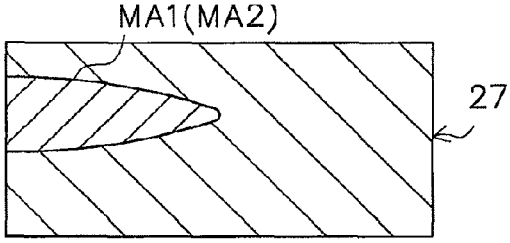
Figure 5E:
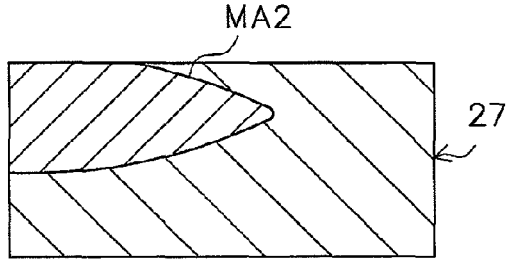
Figure 5F:
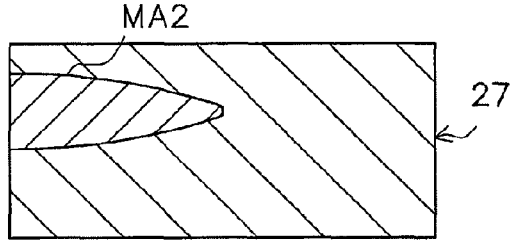
Figure 6A:
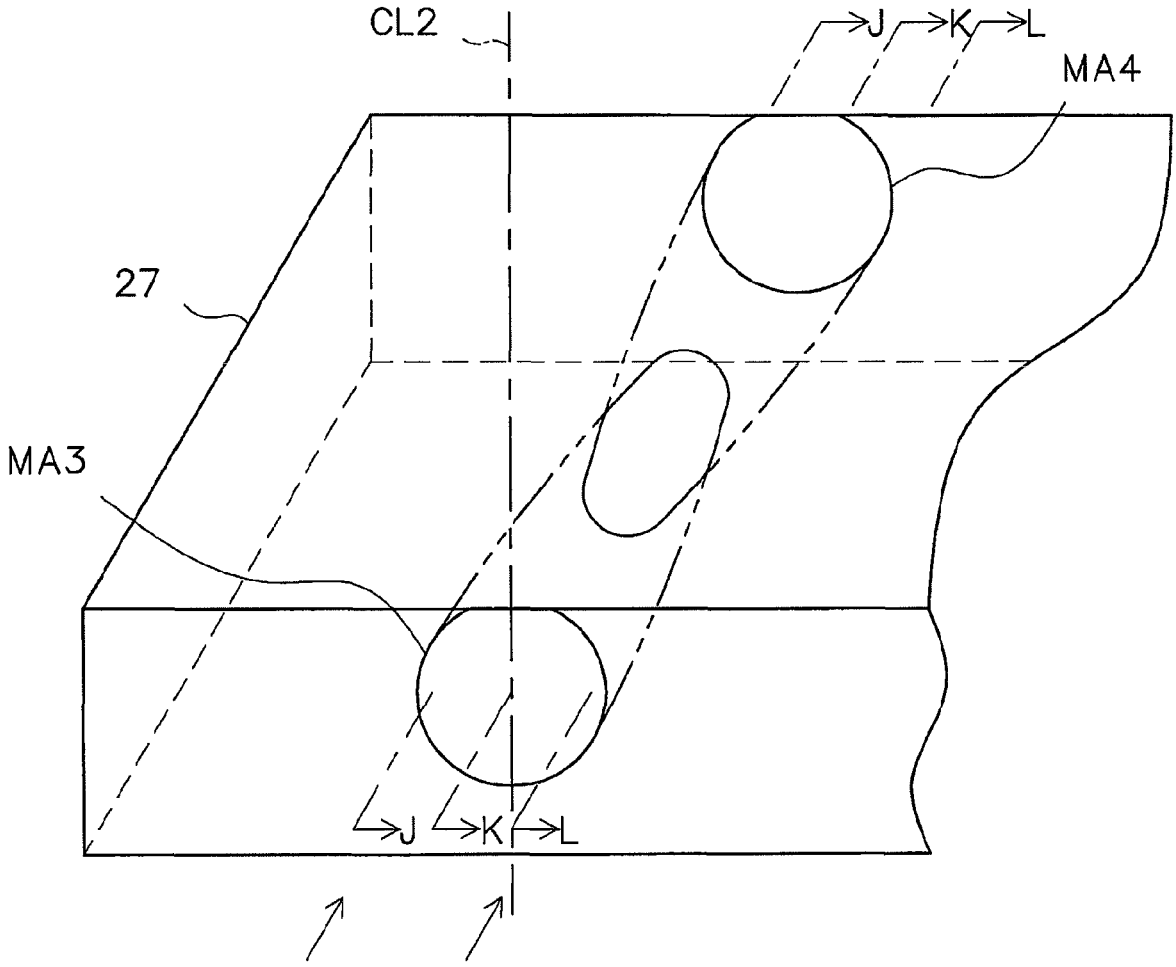
FIG. 6 includes a set of views illustrating a method of obtaining the shape and position of an overlap fusion region, wherein FIG. 6(*a*) is a schematic perspective view showing the ground electrode, etc., FIG. 6(*b*) is a sectional view taken along line J-J of FIG. 6(*a*), FIG. 6(*c*) is a sectional view taken along line K-K of FIG. 6(*a*), and FIG. 6(*d*) is a sectional view taken along line L-L of FIG. 6(*a*).
Figure 6B:
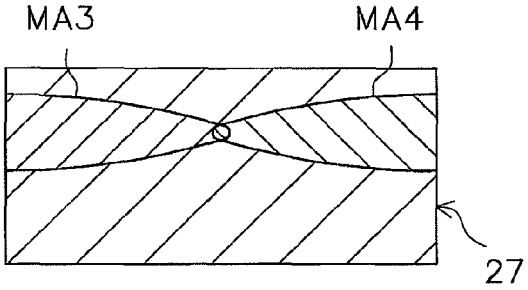
Figure 6D:
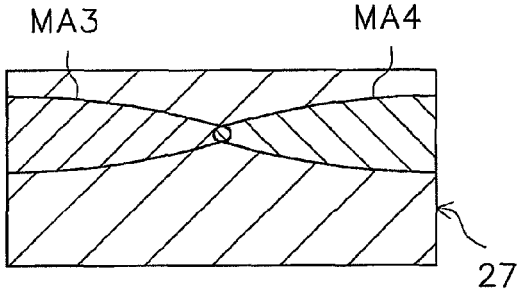
Figure 6C:
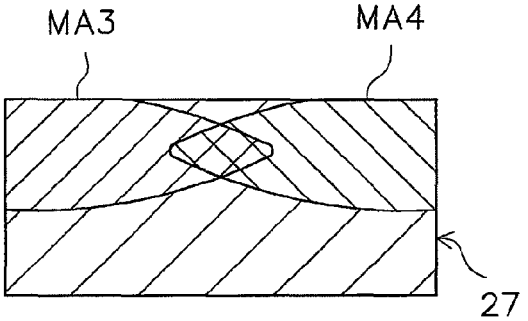

In the present embodiment, as shown in FIGS. 3(*a*) and 3(*b*) and FIG. 4, the fusion zone 35 is formed by irradiating a distal end surface 27F and opposite side surfaces 27S1 and 27S2 of the ground electrode 27 with a laser beam or an electron beam. More specifically, the fusion zone 35 consists of fusion regions 35*a*, 35*b*, 35*c*, 35*d* and 35*e*. The fusion regions 35*a* and 35*b* are formed by irradiating the side surface 27S1 of the ground electrode 27 with a laser beam or an electron beam at two positions, along a direction (in FIG. 4, the direction of an inline arrow) parallel to a surface (discharge surface) of the noble metal tip 32 adapted to form the spark discharge gap 33 and orthogonal to the longitudinal direction of the ground electrode 27. The fusion regions 35*c* and 35*d* are formed by irradiating the side surface 27S2 of the ground electrode 27 with a laser beam or an electron beam at two positions corresponding to the two positions of the fusion regions 35*a* and 35*b*, along a direction parallel to the discharge surface of the noble metal tip 32 and orthogonal to the longitudinal direction of the ground electrode 27, thereby being formed on a side opposite the fusion regions 35*a* and 35*b*. Further, the fusion region 35*e* is formed as follows: while irradiating the distal end surface 27F of the ground electrode 27 with a laser beam or an electron beam in parallel with the discharge surface of the noble metal tip 32 and along the longitudinal direction of the ground electrode 27, the irradiation position is gradually moved along the width direction of the ground electrode 27. By irradiating the distal end surface 27F and the side surfaces 27S1 and 27S2 of the ground electrode 27 with the laser beam or the electron beam in this manner, the fusion zone 35 is not exposed from the discharge surface of the noble metal tip 32.

Notably, when the side surface 27S1 of the ground electrode 27 is taken as the "first surface" in the present invention, the distal end surface 27F and the side surface 27S2 of the ground electrode 27 correspond to the "second surface" in the present invention. When the side surface 27S1 of the ground electrode 27 is taken as the "first surface" in the present invention, the fusion regions 35*a* and 35*b* formed by irradiating the side surface 27S1 with the laser beam or the electron beam correspond to the "first fusion region" in the present invention, and the fusion regions 35*c*, 35*d* and 35*e* formed by irradiating the distal end surface 27F and the side surface 27S2 with the laser beam or the electron beam correspond to the "second fusion region" in the present invention.

Further, in the present embodiment, as shown in FIG. 3(*b*), as viewed on a projection plane which is orthogonal to the center axis CL2 of the noble metal tip 32 and on which the noble metal tip 32 and the fusion zone 35 are projected along the center axis CL2, an overlapping region AO1 (in FIG. 3(*b*), the hatched region) between the noble metal tip 32 and the fusion zone 35 accounts for 70% or more (e.g., 100%) of a projected region AP1 (in FIG. 3(*b*), the region surrounded by the bold line) of the noble metal tip 32.

Additionally, as shown in FIGS. 3(*b*) and 4, in the fusion zone 35, the fusion regions 35*a* and 35*c* overlap each other to form an overlap fusion region 37*a*; the fusion regions 35*b* and 35*d* overlap each other to form an overlap fusion region 37*b*; the fusion regions 35*b* and 35*e* overlap each other to form an overlap fusion region 37*c*; the fusion regions 35*d* and 35*e* overlap each other to form an overlap fusion region 37*d*; and the fusion regions 35*b*, 35*d* and 35*e* overlap together to form an overlap fusion region 37*e*. In the present embodiment, the positions forming the fusion regions 35*a* to 35*e* are set such that, when the straight line SL intersecting the center axis CL2 of the noble metal tip 32 and extending along the longitudinal direction of the ground electrode 27 is projected on the aforementioned plane of projection along the center axis CL2 of the noble metal tip 32, the overlap fusion regions 37*a*, 37*b* and 37*e* overlap the straight line SL in the projected region AP1 of the noble metal tip 32.

Notably, the "overlap fusion region" refers to an overlapping region between a fusion region formed by irradiating any one surface (first surface) among the distal end surface 27F and the side surfaces 27S1 and 27S2 of the ground electrode 27 and a fusion region formed by irradiating a surface (second surface) different from the first surface among the distal end surface 27F and the side surfaces 27S1 and 27S2 with the laser beam or the electron beam. Therefore, for example, an overlapping region between the fusion region 35*a* and the fusion region 35*b*, which are formed by irradiating the same side surface 27S1 with the laser beam or the electron beam, is not an "overlap fusion region" of the present invention.

Whether or not an overlap fusion region is present can be judged as follows. Generally, in a fusion region formed by irradiating with a laser beam or an electron beam, a region located within the ground electrode 27 (i.e., a region which remains after removing, from the fusion region, a region penetrating into the noble metal tip 32) assumes a shape which tapers off from an outer surface of the ground electrode 27 toward the interior of the ground electrode 27. Therefore, for example, as shown in FIGS. 5(*a*) to 5(*f*), in the case where an overlap fusion region is not formed, when a plurality of sections of each of fusion regions MA1 and MA2 are taken along a irradiating direction (in FIG. 5(*a*), the direction of inline arrows) of the laser beam or the electron beam for forming the fusion regions MA1 and MA2 and the center axis CL2 of the noble metal tip (not shown in FIGS. 5 to 7), the sections of the fusion regions MA1 and MA2 are shaped such that they decrease in width toward the interior of the ground electrode 27.

Figure 7A:
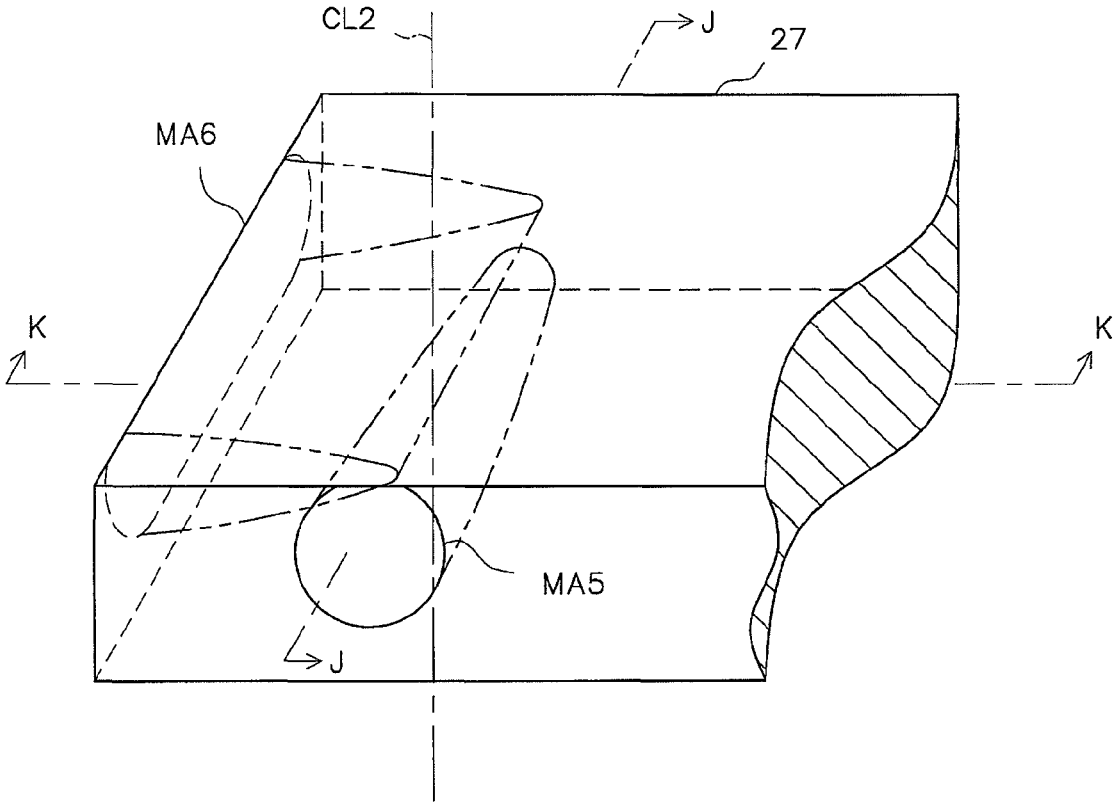
FIG. 7 includes a set of views illustrating a method of obtaining the shape and position of an overlap fusion region, wherein FIG. 7(*a*) is a schematic perspective view showing the ground electrode, etc., FIG. 7(*b*) is a sectional view taken along line J-J of FIG. 7(*a*), and FIG. 7(*c*) is a sectional view taken along line K-K of FIG. 7(*a*).
Figure 7B:
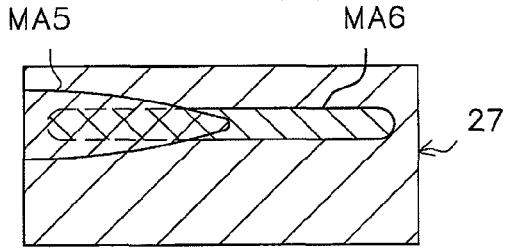
Figure 7C:
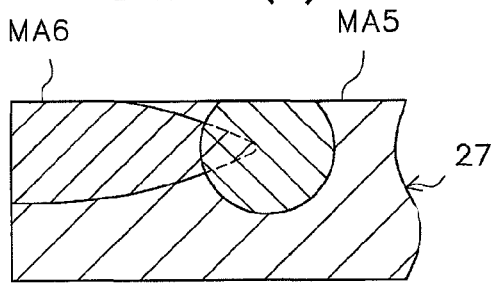

By contrast, in the case where overlap fusion regions are formed, for example, as shown in FIGS. 6(*a*) to 6(*d*) and FIGS. 7(*a*) to 7(*c*), when sections of fusion regions MA3, MA4, MA5 and MA6 are taken in a similar manner as described above, the sections of the fusion regions MA3, MA4, MA5 and MA6 are shaped such that at least a portion of each of the sections remains constant or increases in width toward the interior of the ground electrode 27. Therefore, by utilizing these features, the presence of an overlap fusion region can be determined.

The position at which an overlap fusion region is formed can be obtained as follows. A fusion region (e.g., fusion region MA3 in FIG. 6) is selected whose sectional shape has a portion having a constant or expanding width (inflection portion). On the basis of a sectional shape of the fusion region extending from an externally exposed portion to the inflection portion, successive sectional shapes (e.g., FIGS. 6(*b*) to 6(*d*)) of the fusion region assumed to have no overlap fusion region are estimated. On the basis of the successive estimated sectional shapes, a three-dimensional shape of the fusion region is derived, and the position of the fusion region relative to the ground electrode is obtained. The operation of deriving the shape of the fusion region and the operation of obtaining the relative position of the fusion region to the ground electrode are performed for each fusion region having an inflection portion, thereby obtaining three-dimensional shapes of the fusion regions and positions of the fusion regions relative to the ground electrode. By means of disposing the fusion regions according to their relative positions, the positions in which the overlap fusion regions are formed can be obtained three-dimensionally.

Next, a method of manufacturing the spark plug 1 configured as above is described. First, the metallic shell 3 is formed beforehand. Specifically, a circular columnar metal material (e.g., an iron-based material or a stainless steel material) is subjected to cold forging or the like for forming a general shape and a through hole. Subsequently, machining is conducted so as to adjust the outline, thereby yielding a metallic-shell intermediate.

Then, the ground electrode 27 having the form of a straight rod and formed of an Ni alloy is resistance-welded to the front end surface of the metallic-shell intermediate. The resistance welding is accompanied by formation of so-called "sags." After the "sags" are removed, the threaded portion 15 is formed in a predetermined region of the metallic-shell intermediate by rolling. Thus, the metallic shell 3 to which the ground electrode 27 is welded is obtained. The metallic shell 3 to which the ground electrode 27 is welded is subjected to galvanizing or nickel plating. In order to enhance corrosion resistance, the plated surface may be further subjected to chromate treatment.

Separately from preparation of the metallic shell 3, the insulator 2 is formed. For example, a granular forming material is prepared from a material powder which contains alumina in a predominant amount, a binder, etc. By use of the granular forming material thus prepared, a tubular green compact is formed by rubber press forming. The thus-formed green compact is shaped by grinding. The shaped green compact is placed in a kiln, followed by firing for forming the insulator 2.

Also, separately from preparation of the metallic shell 3 and the insulator 2, the center electrode 5 is formed. Specifically, an Ni alloy prepared such that a copper alloy or the like is disposed in a central portion thereof for the purpose of enhancing heat irradiation is subjected to forging, thereby forming the center electrode 5. Next, the noble metal member 31 made of a noble metal alloy is joined to a front end portion of the center electrode 5 by laser welding or the like.

Next, the insulator 2 and the center electrode 5, which are formed as described above, the resistor 7, and the terminal electrode 6 are fixed in a sealed condition by means of the glass seal layers 8 and 9. In order to form the glass seal layers 8 and 9, generally, a mixture of borosilicate glass and a metal powder is prepared, and the prepared mixture is charged into the axial hole 4 of the insulator 2 such that the resistor 7 is sandwiched therebetween. Subsequently, the resultant assembly is heated in a kiln while the charged mixture is pressed from the rear by the terminal electrode 6, thereby being fired and fixed. At this time, a glaze layer may be simultaneously fired on the surface of the rear trunk portion 10 of the insulator 2; alternatively, the glaze layer may be formed beforehand.

Subsequently, the thus-formed insulator 2 having the center electrode 5, the terminal electrode 6, etc., and the metallic shell 3 having the ground electrode 27 are assembled. More specifically, a relatively thin-walled rear-end opening portion of the metallic shell 3 is crimped radially inward; i.e., the above-mentioned crimp portion 20 is formed, thereby fixing the insulator 2 and the metallic shell 3 together.

Next, the noble metal tip 32 is joined to a distal end portion, from which plating is removed, of the ground electrode 27 by means of laser beam welding or electron beam welding.

More specifically, in a state in which the noble metal tip 32 is placed on a predetermined region of the ground electrode 27, the noble metal tip 32 is supported by a predetermined pressing pin. In this condition, a high-energy laser beam, such as a fiber laser beam or an electron beam, is directed to predetermined positions on the side surfaces 27S1 and 27S2 of the ground electrode 27, thereby forming the fusion regions 35*a*, 35*b*, 35*c* and 35*d*, in which the material of the ground electrode 27 and the material of the noble metal tip 32 are fused together. Also, while the high-energy laser beam is directed to the distal end surface 27F of the ground electrode 27, the laser irradiation position is moved along the width direction of the ground electrode 27, thereby forming the fusion region 35*e*. Thus, the fusion zone 35 consisting of the fusion regions 35*a*, 35*b*, 35*c*, 35*d* and 35*e* is formed, whereby the noble metal tip 32 is joined to the ground electrode 27.

In the present embodiment, the irradiation conditions of the laser beam or the like are set such that an overlapping region AO1 between the noble metal tip 32 and the fusion zone 35 accounts for 70% or more of the projected region AP1 of the noble metal tip 32. For the noble metal tips 32 which differ in outside diameter or material, by means of appropriately adjusting the output and irradiation time of the laser beam or the like and the emitting pattern (continuous wave, interrupted waves (pulses), etc.) of the laser beam or the like, the fusion zone 35 can be formed such that the region AO1 accounts for 70% or more of the region AP1.

After the noble metal tip 32 is joined to the ground electrode 27, an intermediate portion of the ground electrode 27 is bent toward the center electrode 5. Then, the width of the spark discharge gap 33 between the noble metal member 31 and the noble metal tip 32 is adjusted, thereby yielding the spark plug 1 described above.

As described in detail above, according to the present embodiment, as viewed on a projection plane which is orthogonal to the center axis CL2 of the noble metal tip 32 and on which the noble metal tip 32 and the fusion zone 35 are projected along the center axis CL2, the overlapping region AO1 between the noble metal tip 32 and the fusion zone 35 accounts for 70% or more of the projected region AP1 of the noble metal tip 32. That is, the noble metal tip 32 is joined to the ground electrode 27 via a sufficiently wide fusion zone 35. Therefore, even though a relatively large thermal stress difference arises between the ground electrode 27 and the noble metal tip 32, which has a large discharge surface area of 0.9 $mm^2$ or greater, the fusion zone 35 can sufficiently absorb the difference, whereby the progress of oxide scale in a joined portion between the ground electrode 27 and the noble metal tip 32 can be reliably prevented. As a result, the separation resistance of the noble metal tip 32 can be further reliably improved.

Also, the fusion zone 35 is formed by irradiating the distal end surface 27F and side surfaces 27S1 and 27S2 of the ground electrode 27 with a laser beam or an electron beam, rather than the periphery of a contact surface between the ground electrode 27 and the noble metal tip 32. Therefore, even though the sufficiently wide fusion zone 35 is formed as described above, the fusion zone 35 is unlikely to reach or come close to the discharge surface of the noble metal tip 32, and the effect of improving erosion resistance can be sufficiently exhibited by providing the noble metal tip 32. As a result, coupled with the effect obtained by setting the discharge surface of the noble metal tip 32 to an area of 0.9 $mm^2$ or greater, erosion resistance can be remarkably improved.

Further, since the fusion zone 35 can be restrained from reaching or coming close to the discharge surface, the noble metal tip 32 having a relatively small thickness can be used. Thus, an increase in manufacturing cost associated with use of the noble metal tip 32 having an increased diameter can be effectively restrained.

Also, the fusion zone 35 is formed along the entire boundary between the ground electrode 27 and a peripheral portion of a proximal end portion of the noble metal tip 32 and is located in such a manner as to cover a boundary portion between the noble metal tip 32 and the ground electrode 27. Therefore, the presence of the fusion zone 35 can effectively prevent entry of corrosive gas into the boundary portion and can more reliably prevent the progress of oxide scale in a joined portion between the noble metal tip 32 and the ground electrode 27. As a result, the separation resistance of the noble metal tip 32 can be further improved.

Additionally, the fusion zone 35 is formed in such a manner as to extend between the distal end surface 27F and the side surfaces 27S1 and 27S2 of the ground electrode 27. Therefore, the strength of joining of the noble metal tip 32 to the ground electrode 27 can be enhanced, whereby the separation resistance can be further improved.

In addition, as viewed on the aforementioned plane of projection, the overlap fusion regions 35*a*, 35*b* and 35*e* overlap the straight line SL in the projected region AP1 of the noble metal tip 32. Therefore, the fusion zone 35 can further reliably absorb the thermal stress difference which arises between the ground electrode 27 and the noble metal tip 32, whereby the separation resistance of the noble metal tip 32 can yet be further improved.

Also, in joining the noble metal tip 32 to the ground electrode 27, a fiber laser beam or an electron beam is used. Thus, even though the fusion zone 35 is formed over a relatively large region as mentioned above, the fusion zone 35 can have a relatively small volume. Therefore, a portion of the noble metal tip 32 which is melted in joining can be further reduced, so that the volume of the noble metal tip 32 can be further ensured. As a result, erosion resistance can be further improved.

Second Embodiment

Figure 8A:
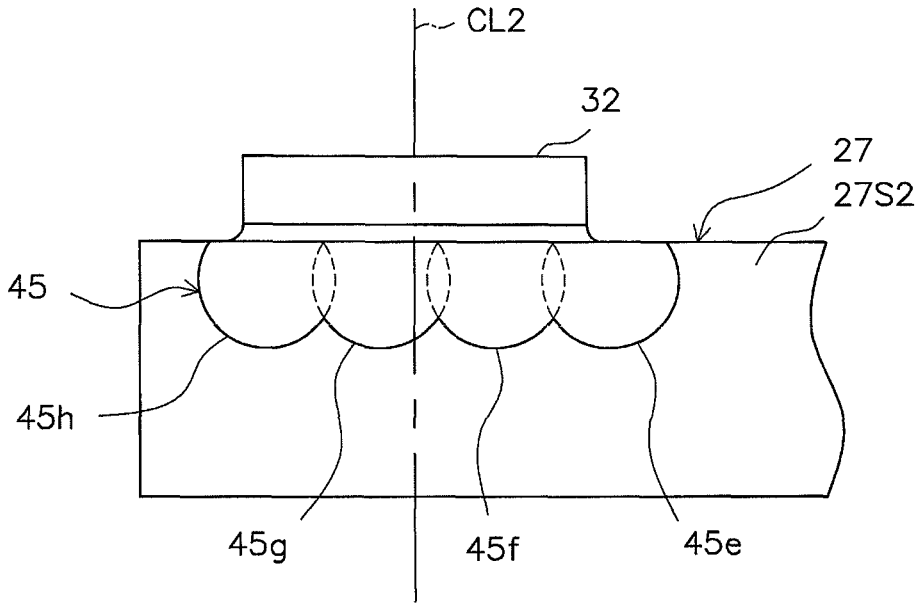
FIG. 8 includes a pair of views illustrating the configuration of a fusion zone in a second embodiment of the present invention, wherein FIG. 8(*a*) is an enlarged partial side view showing a distal end portion of the ground electrode, and FIG. 8(*b*) is a projection view showing a plane of projection on which the noble metal tip, the fusion zone, etc., are projected.
Figure 8B:
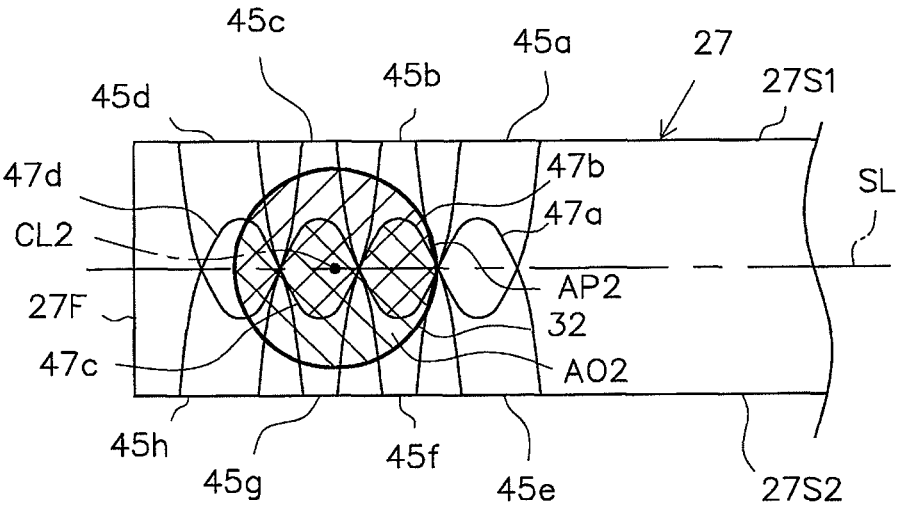

Next, a second embodiment of the present invention will be described, with an emphasis toward differences from the first embodiment described above. In the second embodiment, as shown in FIGS. 8(*a*) and 8(*b*), the positions radiated with a laser beam or an electron beam in joining the noble metal tip 32 to the ground electrode 27 differ from those of the first embodiment. As a result, a formed fusion zone 45 differs in configuration from the fusion zone 35 of the first embodiment.

More specifically, the fusion zone 45 consists of fusion regions 45*a*, 45*b*, 45*c*, 45*d*, 45*e*, 45*f*, 45*g* and 45*h*. The fusion regions 45*a*, 45*b*, 45*c* and 45*d* are formed by irradiating the side surface 27S1 of the ground electrode 27 with a laser beam or an electron beam at four positions, along a direction parallel to the discharge surface of the noble metal tip 32 and orthogonal to the longitudinal direction of the ground electrode 27. The fusion regions 45*e*, 45*f*, 45*g* and 45*h* are formed by irradiating the side surface 27S2 of the ground electrode 27 with a laser beam or an electron beam at four positions corresponding to the four positions of the fusion regions 45*a*, 45*b*, 45*c* and 45*d*, along a direction parallel to the discharge surface of the noble metal tip 32 and orthogonal to the longitudinal direction of the ground electrode 27. That is, the fusion regions 45*e*, 45*f*, 45*g* and 45*h* are formed on a side opposite the fusion regions 45*a*, 45*b*, 45*c* and 45*d*, respectively. Similar to the first embodiment described above, as viewed on a projection plane which is orthogonal to the center axis CL2 of the noble metal tip 32 and on which the noble metal tip 32 and the fusion zone 45 are projected along the center axis CL2, an overlapping region AO2 (in FIG. 8(*b*), the hatched region) between the noble metal tip 32 and the fusion zone 45 accounts for 70% or more of a projected region AP2 (in FIG. 8(*b*), the region surrounded by the bold line) of the noble metal tip 32.

Additionally, in the fusion zone 45, the fusion regions 45*a* and 45*e* overlap each other to form an overlap fusion region 47*a*; the fusion regions 45*b* and 45*f* overlap each other to form an overlap fusion region 47*b*; the fusion regions 45*c* and 45*g* overlap each other to form an overlap fusion region 47*c*; and the fusion regions 45*d* and 45*h* overlap each other to form an overlap fusion region 47*d*. In the present embodiment, the positions forming the fusion regions 45*a* to 45*h* are set such that, when the straight line SL intersecting the center axis CL2 of the noble metal tip 32 and extending along the longitudinal direction of the ground electrode 27 and the center axis CL2 of the noble metal tip 32 are projected on the aforementioned plane of projection along the center axis CL2 of the noble metal tip 32, the overlap fusion regions 47*a*, 47*b*, 47*c* and 47*d* overlap the straight line SL, and the overlap fusion region 47*c* overlaps the center axis CL2.

As discussed above, according to the second embodiment, as viewed on the aforementioned plane of projection, the overlap fusion region 47*c* overlaps the center axis CL2 of the noble metal tip 32. Thus, the fusion zone 45 can far more reliably absorb the thermal stress difference which arises between the ground electrode 27 and the noble metal tip 32. As a result, the separation resistance of the noble metal tip 32 can be remarkably improved.

Figure 9:
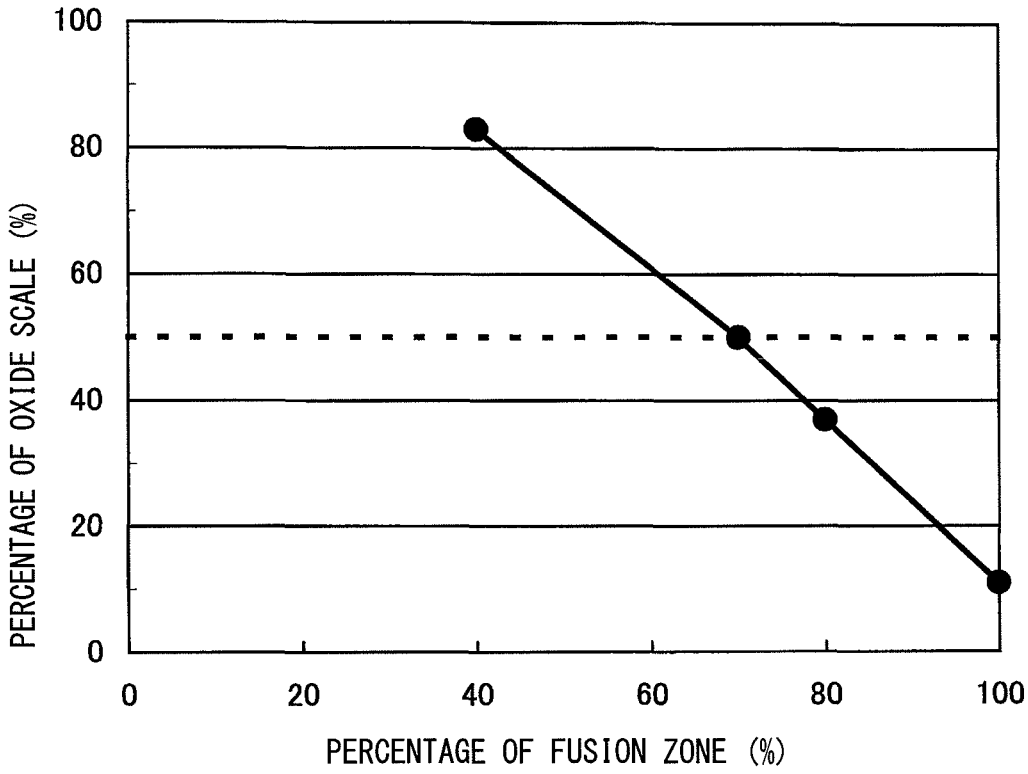
FIG. 9 is a graph showing the results of a desktop burner test conducted on samples having different percentages of fusion region.
Figure 10A:
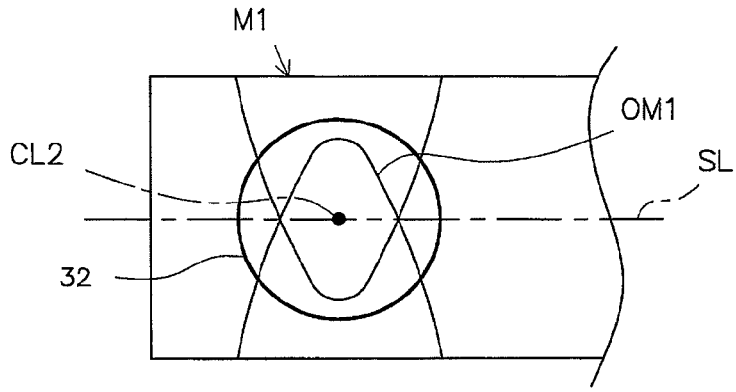
FIG. 10 includes a set of views showing the shapes of fusion zones of samples, wherein FIG. 10(*a*) is a projection view showing a projected fusion zone, etc., of sample 1, FIG. 10(*b*) is a projection view showing a projected fusion zone, etc., of sample 2, FIG. 10(*c*) is a projection view showing a projected fusion zone, etc., of sample 3, and FIG. 10(*d*) is a projection view showing a projected fusion zone, etc., of sample 4.
Figure 10B:
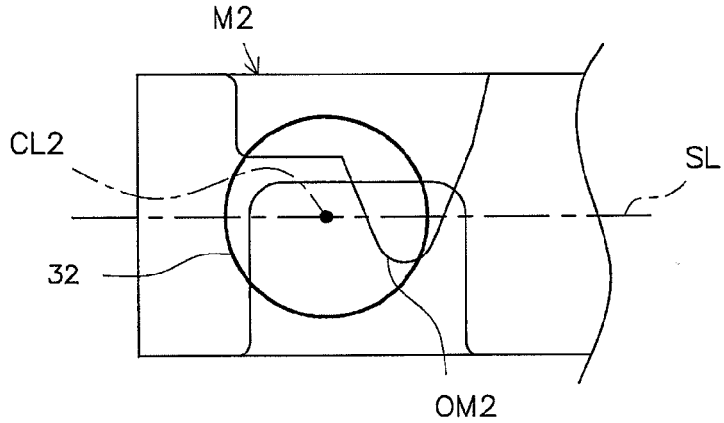
Figure 10C:
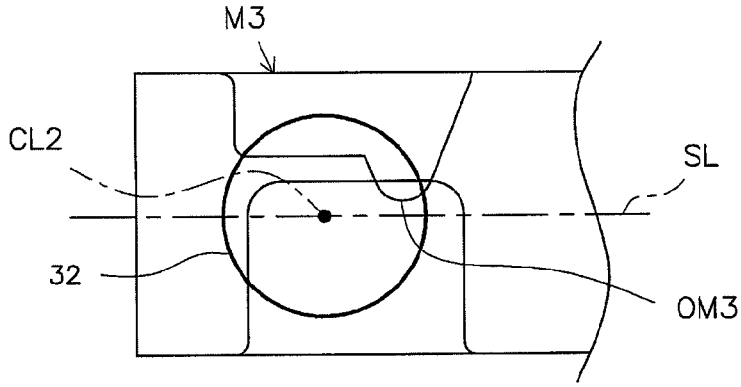
Figure 10D:
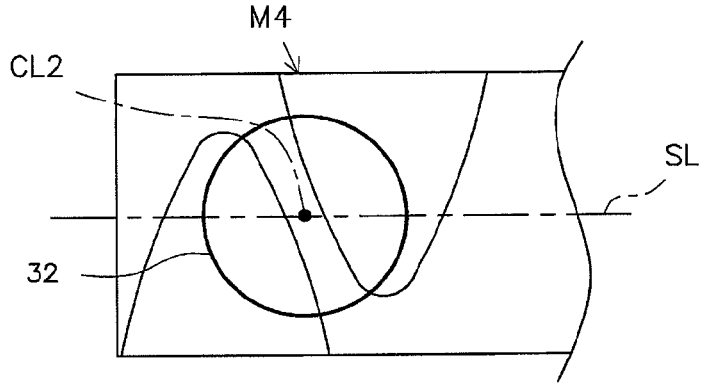

Next, in order to verify the actions and effects realized by the above embodiments, spark plug samples were fabricated while the percentage of an overlapping region between the noble metal tip and the fusion zone to a projected region of the noble metal tip (percentage of fusion region) as viewed on the aforementioned plane of projection was varied by varying the irradiation conditions of a laser beam. The samples were subjected to a desktop burner test. The desktop burner test was carried out as follows. The samples were subjected to 1,000 thermal cycles. In one thermal cycle, the samples were heated for two minutes by a burner such that the noble metal tips were heated to a temperature of 1,050° C. Subsequently, the heated samples were gradually cooled for one minute in the atmosphere. Upon completing 1,000 thermal cycles, the sections of the samples were observed to measure the percentage of the length of an oxide scale formed on a boundary surface between the fusion zone and the ground electrode or the noble metal tip to the length of the boundary surface (percentage of oxide scale). FIG. 9 is a graph showing the relationship between the percentage of fusion zone and the percentage of oxide scale. The noble metal tips used in the test had an outside diameter of 1.2 mm (a discharge surface area of about 1.1 $mm^2$) and a thickness of 0.4 mm. The ground electrodes had a width of 2.8 mm and a thickness of 1.5 mm. Additionally, in the samples, the fusion zones were formed such that overlap fusion regions were not formed.

As shown in FIG. 9, the samples having a percentage of fusion zone of less than 70% exhibited an increase in the percentage of oxide scale, indicating that separation resistance of the noble metal tips is insufficient. Conceivably, this is for the following reason. Since the fusion zone was relatively narrow, the fusion zone failed to sufficiently absorb the thermal stress difference which arose between the ground electrode and the large-diameter noble metal tip. As a result, progress of oxide scale could not be sufficiently prevented.

By contrast, the samples having a percentage of fusion zone of 70% or more exhibited a percentage of oxide scale of 50% or less, indicating that the samples have sufficient separation resistance. It has been confirmed that, as the percentage of fusion zone increases, separation resistance can be further improved. Therefore, in order to prevent separation of the noble metal tip, the percentage of fusion zone is preferably 70% or more, more preferably 80% or more, most preferably 100%.

Next, as shown in FIG. 10(*a*), a sample (sample 1) was fabricated in which a fusion zone M1 was formed such that, as viewed on the aforementioned plane of projection, an overlap fusion region OM1 overlapped the center axis CL2 of the noble metal tip 32. As shown in FIG. 10(*b*), a sample (sample 2) was fabricated in which a fusion zone M2 was formed such that, as viewed on the aforementioned plane of projection, an overlap fusion region OM2 overlapped the straight line SL. As shown in FIG. 10(*c*), a sample (sample 3) was fabricated in which a fusion zone M3 was formed such that, as viewed on the aforementioned plane of projection, an overlap fusion region OM3 deviated from the straight line SL. As shown in FIG. 10(*d*), a sample (sample 4) was fabricated in which, as viewed on the aforementioned plane of projection, an overlap fusion region was not formed in a fusion zone M4. The samples were subjected to the above-described desktop burner test. Table 1 shows the test results of the samples. Notably, the samples had a percentage of fusion zone of 70% and employed noble metal tips and ground electrodes which were identical in size with the samples which were subjected to the previously mentioned test.

TABLE 1

| Sample | Percentage of oxide scale (%) |
|---|---|
| Sample 1 | 20 |
| Sample 2 | 25 |
| Sample 3 | 30 |
| Sample 4 | 50 |

As shown in Table 1, the samples (samples 1 to 3) having the respective overlap fusion regions OM1, OM2 and OM3 exhibited a large reduction in the percentage of oxide scale, indicating that the samples have excellent separation resistance. Conceivably, this is because the formation of an overlap fusion region enhances the strength of joining of the noble metal tip to the ground electrode.

Also, the samples (samples 1 and 2) in which, as viewed on the plane of projection, the respective overlap fusion regions OM1 and OM2 overlap the straight line SL exhibited excellent separation resistance. Particularly, the sample (sample 1) in which, as viewed on the plane of projection, the overlap fusion region OM1 overlaps the center axis CL2 of the noble metal tip exhibited quite excellent separation resistance. Conceivably, this is because, by means of forming an overlap fusion region in such a manner as to overlap the straight line SL or the center axis CL2 as viewed on the plane of projection, the fusion zone more effectively absorbs the thermal stress difference which arises between the ground electrode and the noble metal tip. As a result, the progress of oxide scale is very effectively restrained.

From the test results mentioned above, for improving separation resistance, preferably, the fusion zone is formed in such a manner as to form an overlap fusion region. For further improving separation resistance, more preferably, as viewed on the plane of projection, an overlap fusion region overlaps the straight line SL; and, most preferably, as viewed on the plane of projection, an overlap fusion region overlaps the center axis CL2 of the noble metal tip.

Next, by varying the irradiation energy and irradiation position of a laser beam, a sample (sample 5) was fabricated in which the fusion zone was not exposed from a surface (discharge surface) of the noble metal tip adapted to form the spark discharge gap, and a sample (sample 6) was fabricated in which the fusion zone was exposed from the discharge surface. The samples were subjected to a desktop spark test. The desktop spark test was carried out as follows. The frequency of voltage applied to the samples was 100 Hz (i.e., 6,000 discharges per minute were generated), and the samples were operated to generate discharges for 100 hours in the atmosphere having a pressure of 0.4 MPa. After the elapse of 100 hours, the noble metal tips (fusion zones) were measured for eroded volume associated with the spark discharges. Table 2 shows the results of the desktop spark test. The samples employed noble metal tips and ground electrodes which were identical in size with the samples which were subjected to the previously mentioned tests.

TABLE 2

| Sample | Eroded volume ($mm^3$) |
|---|---|
| Sample 5 | 0.1 |
| Sample 6 | 0.2 |

As shown in Table 2, the sample (sample 5) in which the fusion zone is not exposed from the discharge surface exhibited a relatively small eroded volume, indicating that the sample has excellent erosion resistance. Therefore, for improving erosion resistance, preferably, the fusion zone is formed in such a manner as not to be exposed from the discharge surface.

Figure 11:
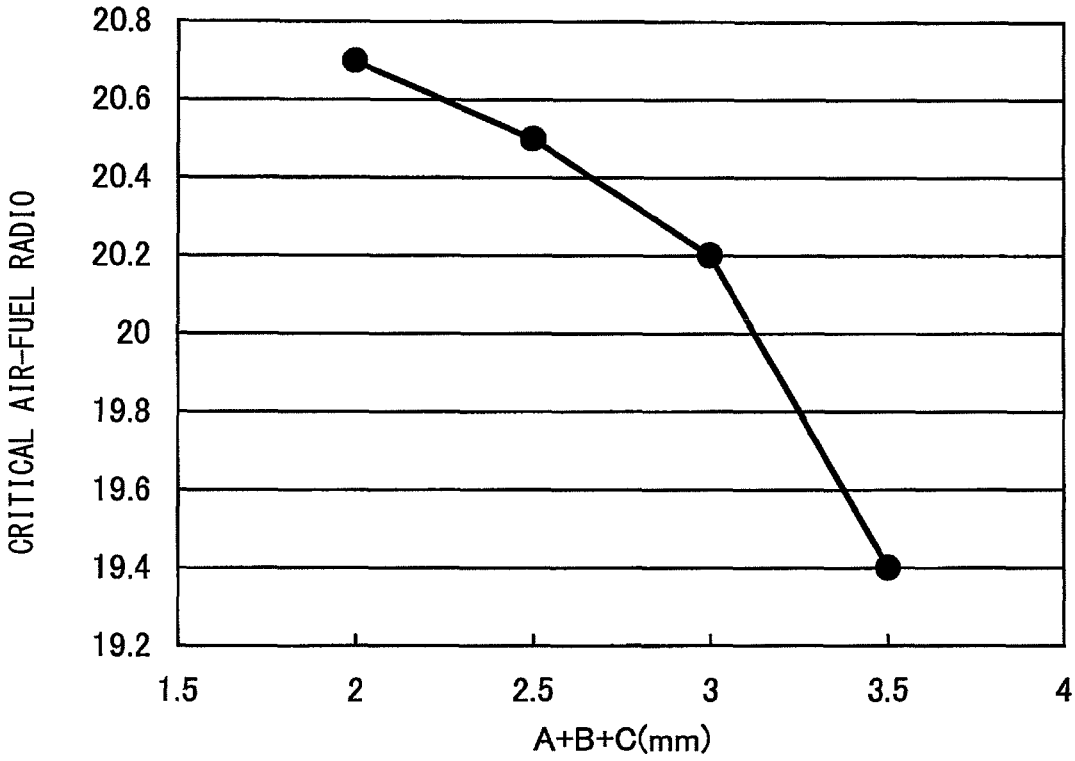
FIG. 11 is a graph showing the results of an ignition-performance evaluation test.

Next, spark plug samples were fabricated while the width (in the above embodiments, the dimension of "A+B+C") of the ground electrode was varied. The samples were subjected to an ignition-performance evaluation test. The ignition-performance evaluation test was carried out as follows. The samples were mounted to a predetermined engine. Then, while the air-fuel (A/F) ratio was gradually increased, spark discharges were generated at a rotational speed of 2,000 rpm. An air-fuel ratio at which, among 1,000 discharges, 10 or more discharges were abnormal (occurrence of misfire) was defined as a critical air-fuel ratio. Notably, an increase in the critical air-fuel ratio indicates improved ignition performance. FIG. 11 is a graph showing the relationship between the critical air-fuel ratio and the value of A+B+C.

As shown in FIG. 11, the samples having a value of A+B+C of 3.0 mm or less exhibited a critical air-fuel ratio in excess of 20.0, indicating that the samples have excellent ignition performance. Therefore, for improving ignition performance, preferably, the relation $A+B+C \leqq 3.0$ mm is satisfied.

The present invention is not limited to the above-described embodiments, but may be embodied, for example, as follows. Of course, application examples and modifications other than those described below are also possible.

Figure 12:
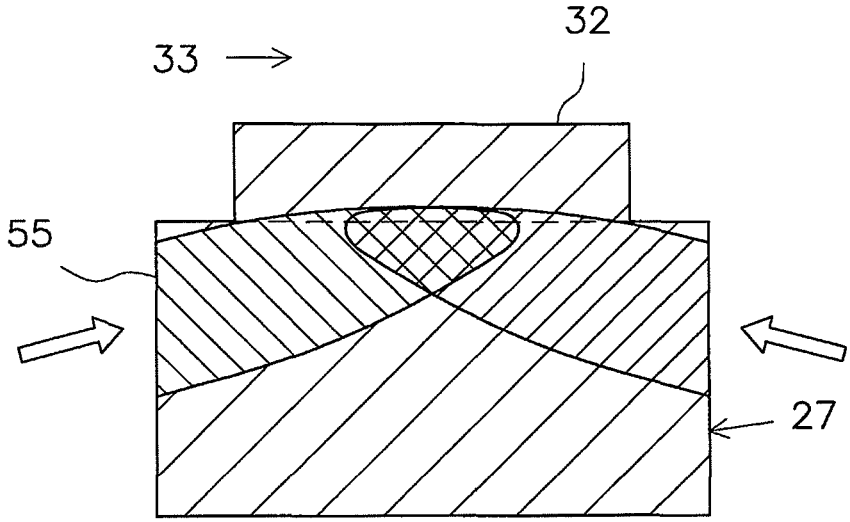
FIG. 12 is an enlarged partial, sectional view illustrating the direction of irradiation, etc., of a laser beam in another embodiment of the present invention.
Figure 13:
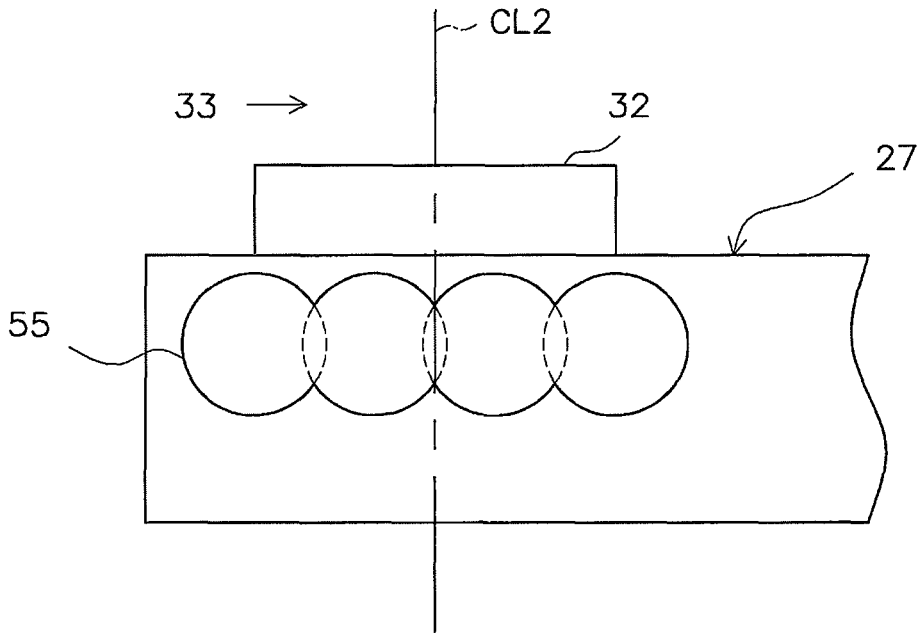
FIG. 13 is an enlarged partial side view showing the configuration of a fusion zone, etc., in another embodiment.

(a) In the above-described embodiments, the noble metal tip 32 is irradiated with the laser beam or the like in a direction parallel to the discharge surface of the noble metal tip 32. However, as shown in FIG. 12, a fusion zone 55 may be formed by irradiating with a laser beam along directions (in FIG. 12, the directions of inline arrows) inclined toward a side opposite the discharge surface of the noble metal tip 32 (toward the back surface side of the ground electrode 27). In this case, at the time of joining, the amount of fusion of a portion of the noble metal tip 32 can be further reduced, whereby the volume of the noble metal tip 32 can be further increased. As a result, erosion resistance can be further improved. Also, as shown in FIG. 13, it is easier to form the fusion region 55 so as not to be exposed toward the spark discharge gap 33. By virtue of the configuration in which the fusion zone 55 is not exposed toward the spark discharge gap 33, durability can be improved.

(b) The configurations of the fusion zones 35 and 45 in the above-described embodiments are mere examples. No particular limitation is imposed on the configuration of the fusion zone (the shape and the number of fusion regions) so long as, as viewed on the aforementioned plane of projection, an overlapping region between the noble metal tip 32 and the fusion zone account for 70% or more of a projected region of the noble metal tip 32.

Figure 14A:
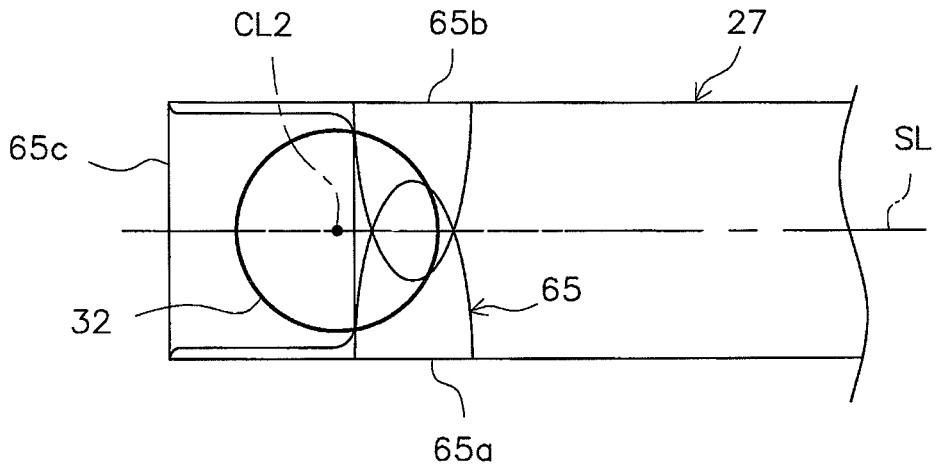
FIG. 14 includes a pair of projection views illustrating the configuration of a fusion zone, wherein FIG. 14(*a*) illustrates the configuration of a fusion zone in a further embodiment, and FIG. 14(*b*) in yet another embodiment.
Figure 14B:
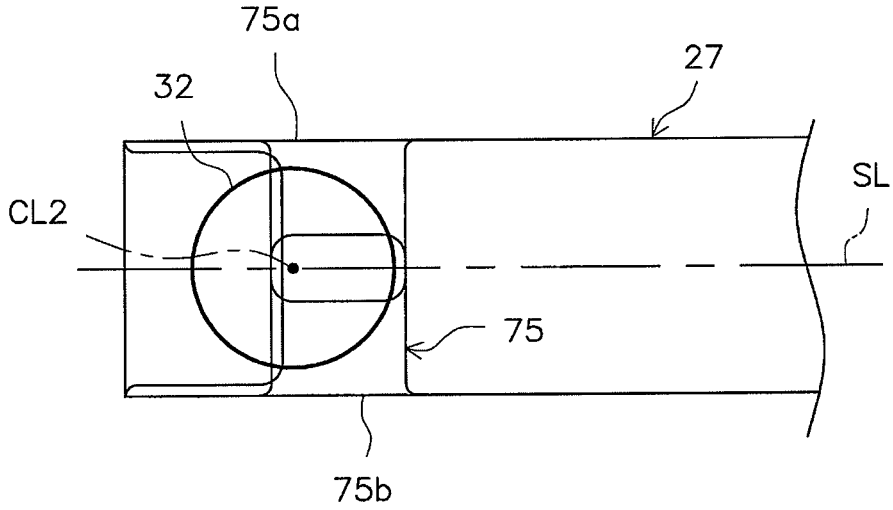

Therefore, for example, as shown in FIG. 14(*a*), a fusion zone 65 may consist of three fusion regions 65*a*, 65*b* and 65*c*.

Also, as shown in FIG. 14(*b*), a fusion zone 75 may be formed in such a manner as to have relatively wide fusion regions 75*a* and 75*b* by means of changing a method of irradiating the side surfaces 27S1 and 27S2 of the ground electrode 27 with a laser beam.

Figure 15A:
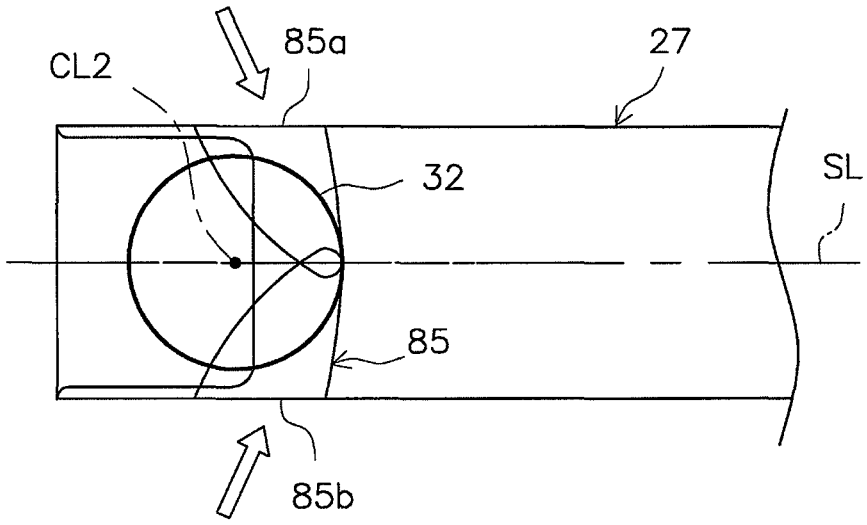
FIG. 15 includes a pair of projection views illustrating the configuration of a fusion zone, wherein FIG. 15(*a*) illustrates the configuration of a fusion zone in yet another embodiment, and FIG. 15(*b*) in yet a further embodiment.
Figure 15B:
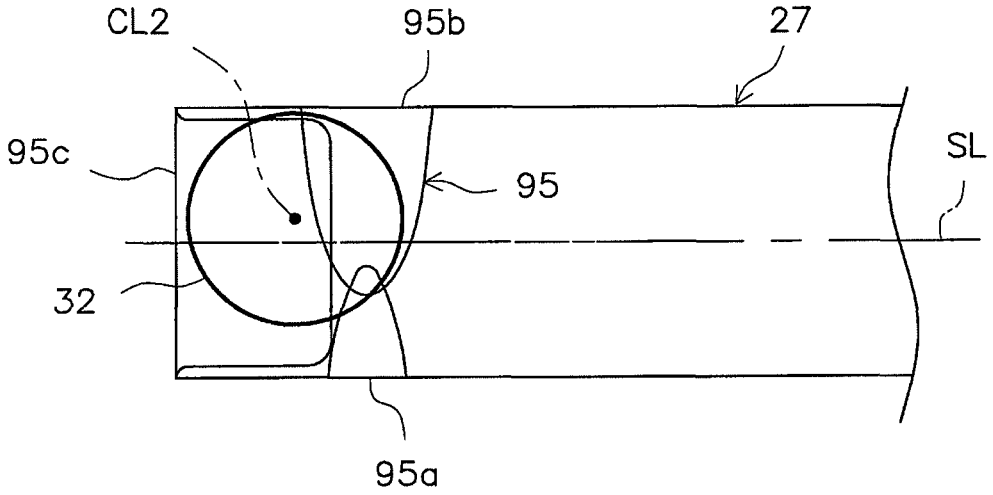

Also, as shown in FIG. 15(*a*), a fusion zone 85 may be formed in such a manner as to have fusion regions 85*a* and 85*b* whose shapes are inclined toward the distal end side of the ground electrode 27, by irradiating with a laser beam or the like from directions (in FIG. 15(*a*), the directions of inline arrows) which are inclined from a direction orthogonal to the longitudinal direction of the ground electrode 27 toward the distal end side of the ground electrode 27.

Further, the irradiation position, irradiation energy, the direction of irradiating, etc., of a laser beam or the like may be changed according to the position of disposition of the noble metal tip 32 in relation to the ground electrode 27. Therefore, as shown in FIG. 15(*b*), a fusion zone 95 may be configured such that fusion regions 95*a*, 95*b* and 95*c* are formed at respective positions which are compatible with the position of disposition of the noble metal tip 32.

Figure 16:
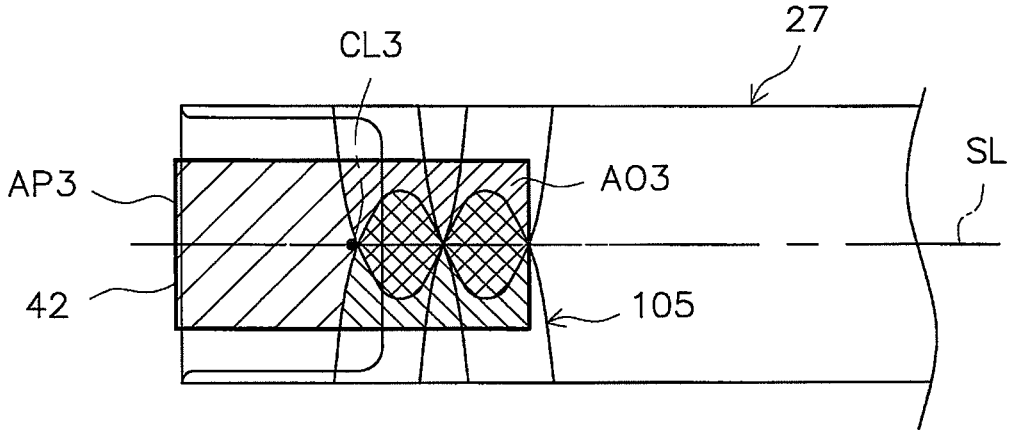
FIG. 16 is a projection view illustrating the configuration of a fusion zone in another embodiment.

(c) In the above-described embodiments, the noble metal tip 32 has a circular columnar shape. However, the shape of the noble metal tip 32 is not limited thereto. Therefore, for example, as shown in FIG. 16, a noble metal tip 42 may have a rectangular cross section. Even in this case, separation resistance of the noble metal tip 42 can be sufficiently improved as follows. As viewed on a projection plane which is orthogonal to the center axis CL3 of the noble metal tip 42 and on which the noble metal tip 42 and a fusion zone 105 are projected along the center axis CL3, an overlapping region AO3 (in FIG. 16, the hatched region) between the noble metal tip 42 and the fusion zone 105 accounts for 70% or more of a projected region AP3 (in FIG. 16, the region surrounded by the bold line) of the noble metal tip 42.

(d) In the above-described embodiments, the noble metal tip 32 is laser-welded to the ground electrode 27 while being supported by a pressing pin. However, the following method may be employed: first, the noble metal tip 32 is temporarily resistance-welded to the ground electrode 27; then, the noble metal tip 32 and the ground electrode 27 are laser-welded together.

(e) The above embodiments are described in reference to a spark plug 1 in which spark discharges are generated across the spark discharge gap 33 substantially along the axis CL1. However, the type of spark plug to which the technical concept of the present invention is applicable is not limited thereto. Therefore, the present invention may be applied to a type of a spark plug in which spark discharges are generated substantially orthogonally to the axis CL1. Also, the present invention may be applied to a type of a spark plug in which spark discharges are generated obliquely with respect to the axis CL1.

(f) In the above-described embodiments, the ground electrode 27 is joined to the front end portion 26 of the metallic shell 3. However, the present invention is also applicable to the case where a portion of metallic shell (or a portion of an end metal welded beforehand to the metallic shell) is cut to form a ground electrode (refer to, for example, Japanese Patent Application Laid-Open (kokai) No. 2006-236906).

(g) In the above-described embodiments, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

It should be further apparent to those skilled in the art that various changes in form and detail of the invention as shown and described above may be made. It is intended that such changes be made within the spirit and scope of the claims appended hereto.

This application claims priority from Japanese Patent Application No. 2009-276230 filed Dec. 4, 2009, incorporated herein by reference in its entirety.

What is claimed is:

1. A spark plug which comprises:

a tubular insulator having an axial hole extending therethrough in an axial direction of the spark plug;

a center electrode inserted into a front end portion of the axial hole;

a tubular metallic shell surrounding the insulator;

a ground electrode disposed at a front end portion of the metallic shell; and a noble metal tip joined to a distal end portion of the ground electrode and forming a gap in cooperation with a front end portion of the center electrode, wherein a surface of the noble metal tip which forms the gap has an area of 0.9 $mm^2$ or greater, the noble metal tip is joined to the ground electrode via a fusion zone formed through fusion of a portion of the ground electrode and a portion of the noble metal tip effected by irradiating at least one surface among a distal end surface and side surfaces of the ground electrode with a laser beam or an electron beam;

as viewed on a projection plane orthogonal to a center axis of the noble metal tip and on which the noble metal tip and the fusion zone are projected along the center axis, an overlapping region between the noble metal tip and the fusion zone accounts for 70% or more of a projected region of the noble metal tip;

wherein the fusion zone is formed by irradiating at least a first surface and a second surface different from the first surface among the distal end surface and the side surfaces of the ground electrode with the laser beam or the electron beam, and a first fusion region formed by irradiating the first surface with the laser beam or the electron beam and a second fusion region formed by irradiating the second surface with the laser beam or the electron beam overlap each other, thereby forming an overlap fusion region; and wherein, when the noble metal tip, the fusion zone, and a straight line intersecting the center axis of the noble metal tip and extending along a longitudinal direction of the ground electrode are projected on a projection plane along the center axis of the noble metal tip, the overlap fusion region overlaps the straight line in the projected region of the noble metal tip.

2. The spark plug according to claim 1, wherein the fusion zone is formed along an entire boundary between the ground electrode and a peripheral portion of a proximal end portion of the noble metal tip.

3. The spark plug according to claim 1, wherein the fusion zone is not exposed from the surface of the noble metal tip forming the gap.

4. The spark plug according to claim 1, wherein the noble metal tip contains at least one noble metal selected from the group consisting of iridium, platinum, rhodium, ruthenium, palladium and rhenium.

5. The spark plug according to claim 1, wherein the first surface is a distal end surface of the ground electrode and the second surface is a side surface of the ground electrode.

6. The spark plug according to claim 1, wherein the first and second surfaces are opposing side surfaces of the ground electrode.

7. A spark plug which comprises:

a tubular insulator having an axial hole extending therethrough in an axial direction of the spark plug;

a center electrode inserted into a front end portion of the axial hole;

a tubular metallic shell surrounding the insulator;

a ground electrode disposed at a front end portion of the metallic shell; and a noble metal tip joined to a distal end portion of the ground electrode and forming a gap in cooperation with a front end portion of the center eletrode, wherein a or greater, surface of the noble metal tip which forms the gap has an area of 0.9 $mm^2$ or greater, the noble metal tip is joined to the ground electrode via a fusion zone formed through fusion of a portion of the ground electrode and a portion of the noble metal tip effected by irradiating at least one surface among a distal end surface and side surfaces of the ground electrode with a laser beam or an electron beam;

as viewed on a projection plane orthogonal to a center axis of the noble metal tip and on which the noble metal tip and the fusion zone are projected along the center axis, an overlapping region between the noble metal tip and the fusion zone accounts for 70% or more of a projected region of the noble metal tip;

wherein the fusion zone is formed by irradiating at least a first surface and a second surface different from the first surface among the distal end surface and the side surfaces of the ground electrode with the laser beam or the electron beam, and a first fusion region formed by irradiating the first surface with the laser beam or the electron beam and a second fusion region formed by irradiating the second surface with the laser beam or the electron beam overlap each other, thereby forming an overlap fusion region; and wherein, when the center axis of the noble metal tip and the fusion zone are projected on a projection plane along the center axis of the noble metal tip, the overlap fusion region overlaps the center axis of the noble metal tip.

8. A method of manufacturing a spark plug as claimed in claim 7, said spark plug comprising:

a tubular insulator having an axial hole extending therethrough in an axial direction of the spark plug;

a center electrode inserted into a front end portion of the axial hole;

a tubular metallic shell surrounding the insulator;

a ground electrode disposed at a front end portion of the metallic shell; and a noble metal tip joined to a distal end portion of the ground electrode and forming a gap in cooperation with a front end portion of the center electrode, wherein a surface of the noble metal tip which forms the gap has an area of 0.9 $mm^2$ or greater, the noble metal tip is joined to the ground electrode via a fusion zone formed through fusion of a portion of the ground electrode and a portion of the noble metal tip effected by irradiating at least one surface among a distal end surface and side surfaces of the ground electrode with a laser beam or an electron beam; and as viewed on a projection plane orthogonal to a center axis of the noble metal tip and on which the noble metal tip and the fusion zone are projected along the center axis, an overlapping region between the noble metal tip and the fusion zone accounts for 70% or more of a projected region of the noble metal tip, which method comprises placing the noble metal tip on the ground electrode and irradiating a laser beam or an electron beam along a direction which is inclined relative to a contact surface between the noble metal tip and the ground electrode from a side of the contact surface opposite the surface of the noble metal tip which forms the gap, to thereby join the noble metal tip to the ground electrode;

wherein the fusion zone is formed by irradiating at least a first surface and a second surface different from the first surface among the distal end surface and the side surfaces of the ground electrode with the laser beam or the electron beam, and a first fusion region formed by irradiating the first surface with the laser beam or the electron beam and a second fusion region formed by irradiating the second surface with the laser beam or the electron beam overlap each other, thereby forming an overlap fusion region; and wherein, when the center axis of the noble metal tip and the fusion zone are projected on a projection plane along the center axis of the noble metal tip, the overlap fusion region overlaps the center axis of the noble metal tip.

9. A method of manufacturing a spark plug as claimed in claim 1, said spark plug comprising:

a tubular insulator having an axial hole extending therethrough in an axial direction of the spark plug;

a center electrode inserted into a front end portion of the axial hole;

a tubular metallic shell surrounding the insulator;

a ground electrode disposed at a front end portion of the metallic shell; and a noble metal tip joined to a distal end portion of the ground electrode and forming a gap in cooperation with a front end portion of the center electrode, wherein a surface of the noble metal tip which forms the gap has an area of 0.9 $mm^2$ or greater, the noble metal tip is joined to the ground electrode via a fusion zone formed through fusion of a portion of the ground electrode and a portion of the noble metal tip effected by irradiating at least one surface among a distal end surface and side surfaces of the ground electrode with a laser beam or an electron beam; and as viewed on a projection plane orthogonal to a center axis of the noble metal tip and on which the noble metal tip and the fusion zone are projected along the center axis, an overlapping region between the noble metal tip and the fusion zone accounts for 70% or more of a projected region of the noble metal tip, which method comprises placing the noble metal tip on the ground electrode and irradiating a laser beam or an electron beam along a direction which is inclined relative to a contact surface between the noble metal tip and the ground electrode from a side of the contact surface opposite the surface of the noble metal tip which forms the gap, to thereby join the noble metal tip to the ground electrode;

wherein the fusion zone is formed by irradiating at least a first surface and a second surface different from the first surface among the distal end surface and the side surfaces of the ground electrode with the laser beam or the electron beam, and a first fusion region formed by irradiating the first surface with the laser beam or the electron beam and a second fusion region formed by irradiating the second surface with the laser beam or the electron beam overlap each other, thereby forming an overlap fusion region; and wherein, when the noble metal tip, the fusion zone, and a straight line intersecting the center axis of the noble metal and extending along a longitudinal direction of the ground electrode are projected on a projection plane along the center axis of the noble metal tip, the overlap fusion region overlaps the straight line in the projected region of the noble metal tip.

10. The method of manufacturing a spark plug according to claim 9, which comprises joining the noble metal tip to the ground electrode using a fiber laser or the electron beam.

11. The method of manufacturing a spark plug according to claim 9, wherein the first surface is a distal end surface of the ground electrode and the second surface is a side surface of the ground electrode.

12. The method of manufacturing a spark plug according to claim 9, wherein the first and second surfaces are opposing side surfaces of the ground electrode.

* * * * *